US009532422B2

(12) United States Patent
Hinrichs

(10) Patent No.: US 9,532,422 B2
(45) Date of Patent: Dec. 27, 2016

(54) METHOD OF PRIORITIZING AND SYNCHRONIZING EFFECT FUNCTIONS IN AN ILLUMINATION DEVICE

(75) Inventor: Matthias Hinrichs, Prior Lake, MN (US)

(73) Assignee: MARTIN PROFESSIONAL AS, Aarhus N (DK)

( * ) Notice: Subject to any disclaimer, the term of this patent is extended or adjusted under 35 U.S.C. 154(b) by 0 days.

(21) Appl. No.: 14/342,105

(22) PCT Filed: Aug. 31, 2012

(86) PCT No.: PCT/DK2012/050326

§ 371 (c)(1),
(2), (4) Date: Mar. 25, 2014

(87) PCT Pub. No.: WO2013/029630

PCT Pub. Date: Mar. 7, 2013

(65) Prior Publication Data

US 2014/0252987 A1 Sep. 11, 2014

(51) Int. Cl.
*H05B 33/08* (2006.01)
*H05B 37/02* (2006.01)
(Continued)

(52) U.S. Cl.
CPC ..... *H05B 33/0845* (2013.01); *H05B 33/086* (2013.01); *H05B 33/0857* (2013.01);
(Continued)

(58) Field of Classification Search
CPC ..... H05B 33/0845; H05B 33/0857; H05B 33/086; H05B 37/0281; H05B 37/02; H05B 37/0254
(Continued)

(56) References Cited

U.S. PATENT DOCUMENTS

2002/0078221 A1 6/2002 Blackwell et al.
2005/0116667 A1 6/2005 Mueller et al.

OTHER PUBLICATIONS

International Search Report for PCT/DK2012/050326; Nov. 19, 2012.

*Primary Examiner* — Douglas W Owens
*Assistant Examiner* — Syed M Kaiser
(74) *Attorney, Agent, or Firm* — Artegis Law Group, LLP

(57) ABSTRACT

The present invention relates to an illumination device comprising a number of light sources arranged in a first group and in a second and controlling means adapted to control the first group and said second group individually. The controlling means is further adapted to control of light sources based on an input signal indicative of at least a first effect function and a second effect function. The first effect function generates a first output related to the light sources and said second effect function generates a second output light sources. The first and second effect functions are stored in a memory in the in the illumination device. The that controlling means is adapted to control the first and the second group of light sources based on a priority schema and/or synchronizing schema both stored in a memory in the illumination device. The priority schema comprising a number of priority rules defining how the first effect function and the second effect must be executed in relation to each other, and the synchronizing schema comprises a number of synchronizing functions defining how the controlling means must execute the first effect function and the second effect function in relation to time and in relation to each other. The present invention relates also to a method of controlling such illumination device.

29 Claims, 10 Drawing Sheets

(51) Int. Cl.

| | |
|---|---|
| *F21V 21/30* | (2006.01) |
| *F21W 131/406* | (2006.01) |
| *F21Y 101/02* | (2006.01) |
| *F21Y 105/00* | (2016.01) |
| *F21Y 113/00* | (2016.01) |
| *F21V 29/67* | (2015.01) |
| *F21Y 101/00* | (2016.01) |

(52) U.S. Cl.
CPC ..... *F21V 21/30* (2013.01); *F21V 29/67* (2015.01); *F21W 2131/406* (2013.01); *F21Y 2101/00* (2013.01); *F21Y 2101/02* (2013.01); *F21Y 2105/001* (2013.01); *F21Y 2105/10* (2016.08); *F21Y 2113/007* (2013.01); *F21Y 2113/17* (2016.08); *F21Y 2115/10* (2016.08); *H05B 37/0254* (2013.01); *H05B 37/0281* (2013.01)

(58) Field of Classification Search
USPC ..... 315/294, 193, 308, 112
See application file for complete search history.

METHOD OF PRIORITIZING AND SYNCHRONIZING EFFECT FUNCTIONS IN AN ILLUMINATION DEVICE

FIELD OF THE INVENTION

The present invention relates to an illumination device comprising a number of light sources and a number of light collecting means arranged in a housing. The number of light collecting means collect light from at least one of the light sources and convert the collected into a number of source light beams and the light source beams are emitted from said housing.

BACKGROUND OF THE INVENTION

Light fixtures creating various effects are getting more and more used in the entertainment industry in order to create various light effects and mood lighting in connection with live shows, TV shows, sport events or as a part on architectural installation.

Entertainment light fixtures creates typically a light beam having a beam width and a divergence and can for instance be wash/flood fixtures creating a relatively wide light beam with a uniform light distribution or it can be profile fixtures adapted to project an image onto a target surface. There is a tendency that more and more of this kind of fixtures are used in each show or each installation and the fixtures get as a consequence more and more visible for the sectors or TV viewers. The light fixtures typically create the lighting effect at a distance from the light fixture itself and the light fixture is thus not as interesting and esthetic to look at. The fixture manufactures tries as a consequence to provide the fixtures with esthetic designs in order to make the fixtures more interesting to look at. However this is very difficult as the housing of the fixtures typical dependents on physical requirements defined by the technical specifications of the fixture such as optics, mechanics, electronics, cooling etc.

Typically in light shows a large number of different light fixtures are used and one or more central controllers are coupled to and adapted to control the light fixtures. The central controllers are programmed by the light designer/programmer and will thus execute the light show as programmed. One common way of programming a light show comprises the step of creating a number of cues which comprises a number of instructions to a number of light fixtures. The cues are then activated through user interfaces or time codes in the programming. US2002/0078221, US2005/0285547, US2005/0116667 and US2007/0195526 shows typical light systems where a central controller controls the light fixtures in the light system based on programs created by the light designer/programmer. It is rather complicated to program a light show as it requires information of performance and settings of the different light fixtures in the light system.

The LED component has further as a light source changed the look of most lighting luminaries, when using multiple LEDs to replace a single light source. This implies for all lighting industries—general, domestic, industrial, entertainment etc. The most visible change is that all multiple light sources are now exposed to the viewer and the light emits from a larger area. Now that most LED fixtures have visible LEDs, some customers dislike the look of multiple light dots. Instead a more uniform, even light exit is requested, to avoid the cheap looking "funfair" look with an extreme amount of light sources. The dotted "funfair" look appears both on light fixtures which mixes the colors before the light is emitted from the housing and also of light fixtures where the colors are mixed in the air or at the wall.

In some LED fixtures the number of LEDs has been arranged in a number of groups of light sources which can be individually controlled by the controller of the fixture. Various visual effects can be then be created by activating the different groups of light sources according to a predetermined pattern. Some LED fixtures comprise a number of preprogrammed effects defining the predetermined pattern and the LED fixture will execute the preprogrammed effects when receiving instructions to do so. Typically the instruction is sent to the fixture from a central controller as an input indicative of the effect function this makes it possible for a light designer or programmer to create visual effects in an easy and fast way, as he/she do only need to choose one of the preprogrammed effect functions. In some of these LED fixtures it is possible to activate to effect functions at the same time and the LED fixture will simply run the two effect functions simultaneously. It has turned that it can be quite complicated to create nice and good looking visual effects when two different effect functions is combined, as the combination of effect functions does not always look nice. Presently this can be handled in the central controller for instance as described in US2002/0078221, US2005/0285547, US2005/0116667 and US2007/0195526. However this requires that the central controller and the light programmer know how the different types of fixtures can combine different effect and complicates the programming further; especially when many different light fixtures are used in a light system. Further the processing power of the central light controllers are often run at their maximum limit and the aspect of combining different effect functions in light fixtures will require even more processing power at the central light controller.

Another issue is the fact that entertainment light fixtures also are used in relative simple light systems, where only a few light fixtures are used for instance in shops, small bar, private homes, companies etc., where the light system typically is controlled by a person without specific skills and experience in light programming. Typically such light systems are controlled by a simple central light controller with a simplified user interface and limited processing power (compared to the light controllers used for large show) is provided. In such systems it is very difficult for the non-experienced use to create nice light effects using the effect functions of the light functions.

DESCRIPTION OF THE INVENTION

The object of the present invention is to solve the above described limitations related to prior art. This is achieved by an illumination device and method as described in the independent claims. The dependent claims describe possible embodiments of the present invention. The advantages and benefits of the present invention are described in the detailed description of the invention.

DETAILED DESCRIPTION OF THE INVENTION

The present invention is described in view of a moving head lighting fixture including a number of LEDs that generate a light beam, however the person skilled in the art realizes that the present invention relates to illumination devices using any kind of light source such as discharge lamps, OLEDs, plasma sources, halogen sources, fluorescent light sources, etc. and/or combinations thereof. It is to be understood that the illustrated embodiments are simplified and illustrate the principles of the present invention rather than showing an exact embodiment. The skilled person will thus understand that the present invention can be embodied in many different ways and also comprise further components in addition to the shown components.

Figure 1A:
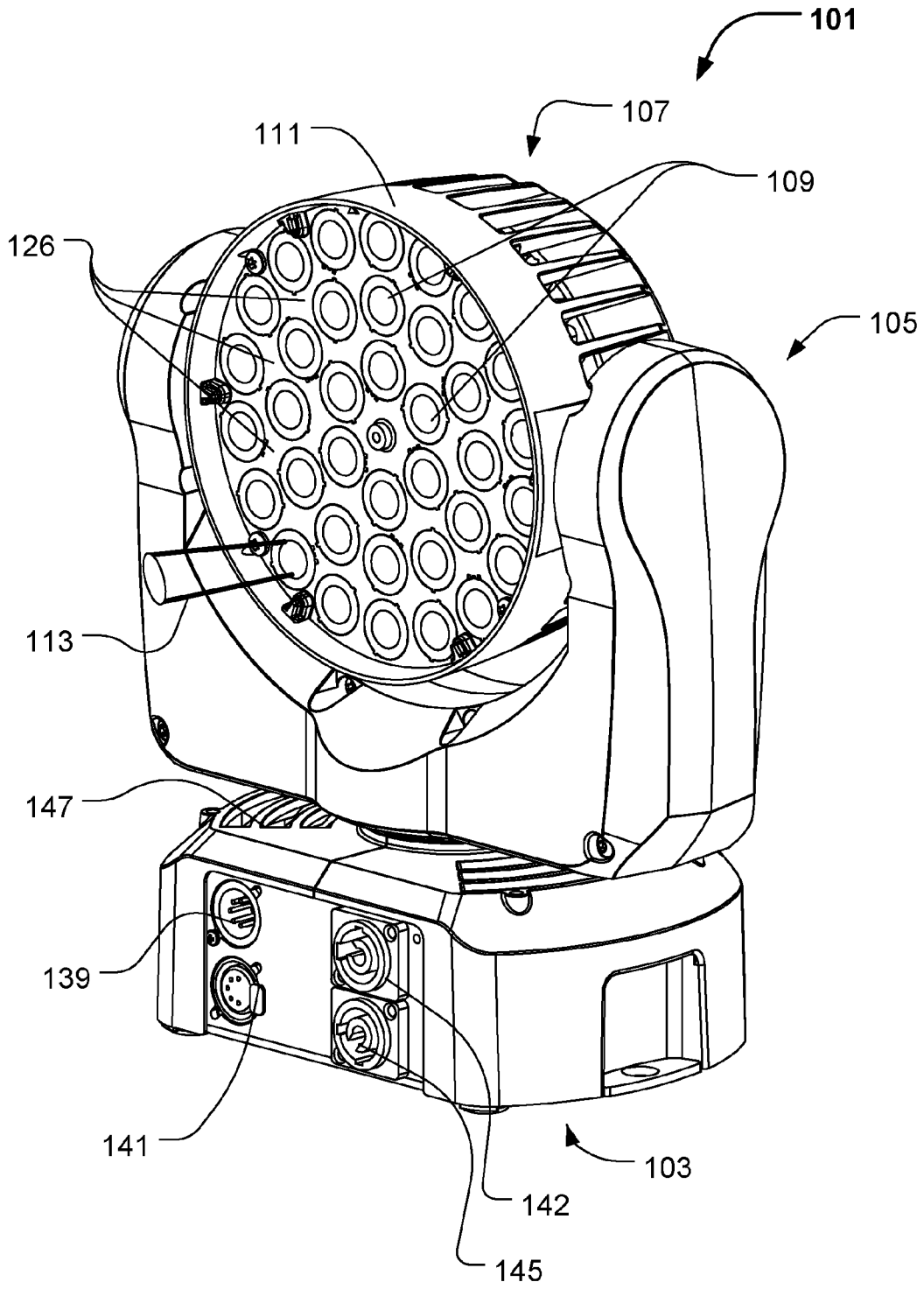
Fig. 1a (Prior art)
FIG. 1*a*-1*c* illustrate an example of a moving head lighting fixture according to prior art.
Figure 1B:
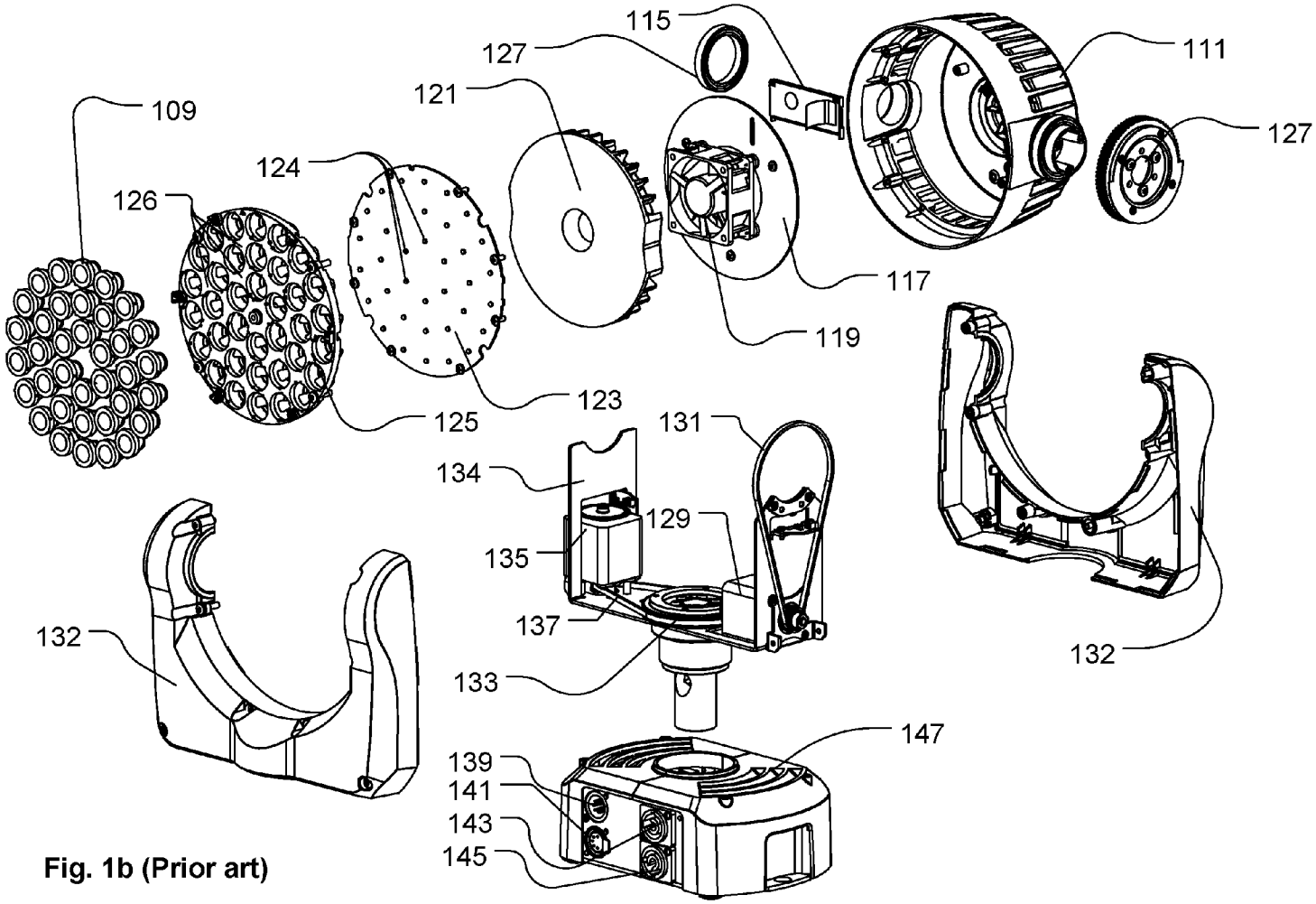
Fig. 1b (Prior art)
Figure 1C:
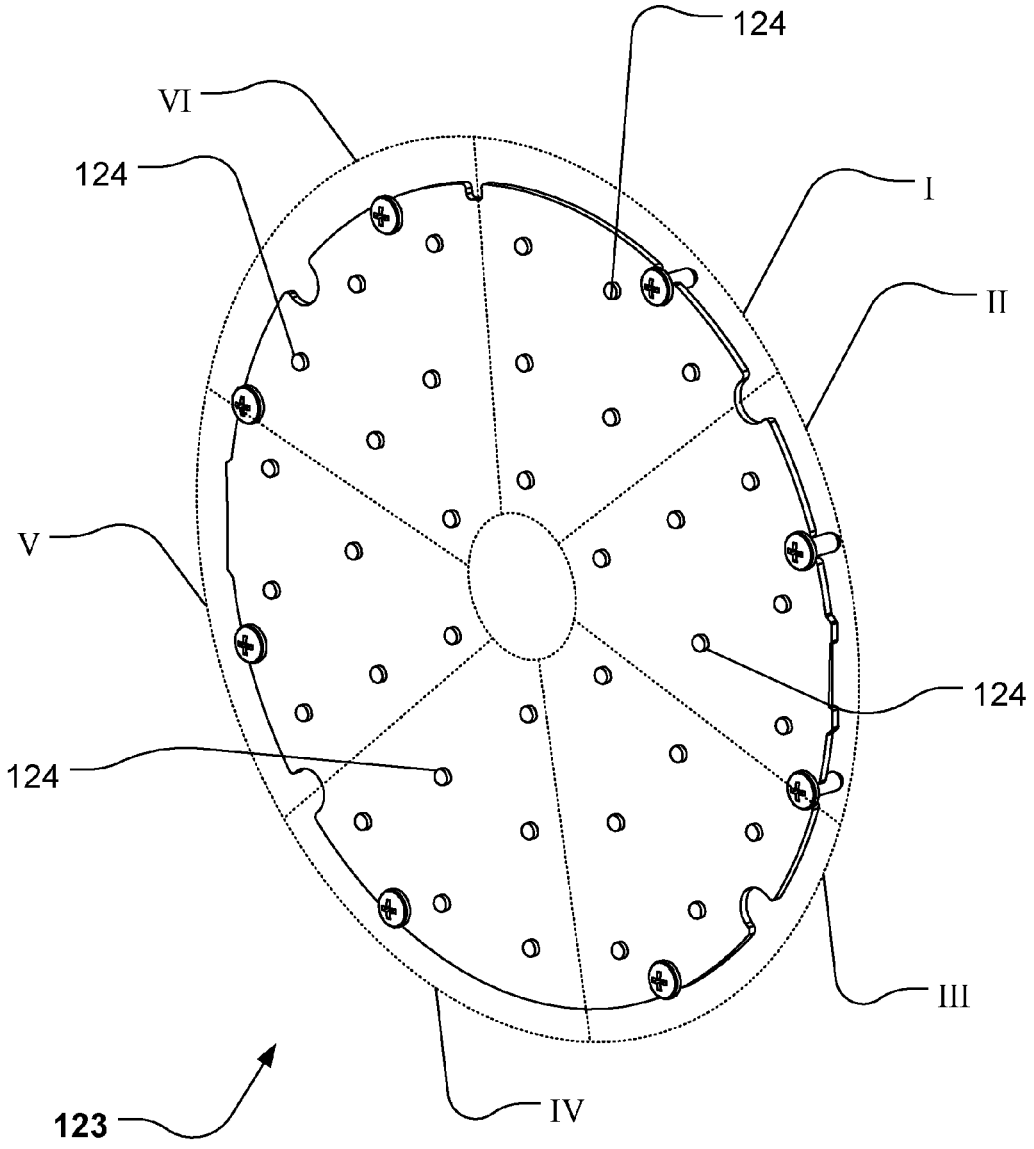
Fig. 1c (Prior art)

FIG. 1*a*-1*c* illustrate an illumination device according to prior art, where FIG. 1*a* is a perspective view, FIG. 1*b* is an exploded view and FIG. 1*c* is a view of a LED PCB where the light sources have been arranged in a number of groups. The illumination device is a moving head lighting fixture 101 comprising a base 103, a yoke 105 rotatable connected to the base 101 and a head rotatable connected 107 to the yoke 105.

In the illustrated embodiment, the head comprises a number of light sources and a number of light collecting means 109 arranged in the head housing 111. The light collecting means collect light from the light sources and convert the collected light into a number of source light beams 113 (only one illustrated), and which are emitted from the housing.

In the illustrated embodiment the head housing 107 is a "bucket" shaped head housing 111 wherein a display 115 (visible from the rear side of the head), main PCB 117 (Printed Circuit Board), a fan 119, a heat sink 121, an LED PCB 123, and lens assembly are stacked. The LED PCB 123 comprises a number of LEDs 124 and the lens assembly comprises a lens holder 125 and a lens array where the lenses constitute the light collecting means 109. Each light collecting means is adapted to collect light form each LED and convert the collected light into a number of light source beams 113. The head is rotatable connected to the yoke by two tilt bearings 127, which are supported by the yoke 105. A tilt motor 129 is adapted to rotate the head through a tilt belt 131 connected to one of the tilt bearings 127. The yoke comprises two interlocked yoke shell parts 132 which are mounted to a yoke frame 134 where on the tilt bearings, tilt motor, pan motor and pan bearing are arranged. The LED PCB 123 comprises a number of LEDs emitting light and which in cooperation with the light collecting means 109 in the lens array generate a number of light source beams. The main PCB comprises controlling circuits and driving circuits (not shown) for controlling the LEDs as known in the art of illumination devices. The main PCB comprises further a number of switches (not shown) which extend through a number of holes in the head housing 111. The switches and display act as a user interface allowing a user to communicate with the moving head lighting fixture.

The yoke are connected to a pan bearing 133 rotatable connected to the base 103. A pan motor 135 is adapted to rotate the yoke through a pan belt 137 connected to the pan bearing 133. The base comprises 5-Pin XLR male 139 and female 141 connectors for DMX signals as known in the art of entertainment lighting; input 143 and output power 145 connectors, power supply PCB's (not shown) and fan (not shown). The fan forces air into the base through vent holes 147.

This prior art illumination device uses multiple LEDs to replace a single light source as known prior the introduction of the LED component as a widely used light source. However such illumination device changes its visible appearance as the multiple light sources are now exposed to the viewer and the light emits from a larger area. If the light luminaries are a color mixing version with single color LEDs, then all LED colors used are visible. However some customers dislike the look of multiple light dots. Instead a more uniform, even light exit is requested, to avoid the cheap looking "funfair" look with an extreme amount of light sources.

The illuminating device illustrated in FIGS. 1*a* and 1*b* is just one example of a prior art illumination derive and the skilled person realize that a large number of different embodiments provided by a large number of manufactures exits.

For instance it is known that the LEDs 124 can be arranged in a number of groups of light sources which can be individually controlled by the controller of the fixture. FIG. 1*c* illustrates an embodiment of the LED PCB 123 of an illumination device where the LED 124 have been arranged in 6 groups I-VI (illustrated by dotted lines) of light sources which can be controlled individually by the controlling means of the illumination device and various visual effects can be then be created by activating the different groups of light sources according to a predetermined pattern. The illumination device can comprise a number of preprogrammed effects defining the predetermined pattern and the controller will execute the preprogrammed effects when receiving instructions to do so. Typically the instruction is sent to the fixture from a central controller as an input signal (e.g. DMX or any other protocol suitable for communication instructions) indicative of the effect function. The makes it possible for a light designer or programmer to create visual effects in an easy and fast way, as he/she do only need to choose one of the preprogrammed effect functions. In some Illumination devices it is possible to activate two effect functions at the same time and the LED fixture will simply run the two effect functions simultaneously. It has turned that it can be quite complicated to create nice and good looking visual effects when two different effect functions is combined, as the combination of effect functions does not always look nice.

Figure 2A:
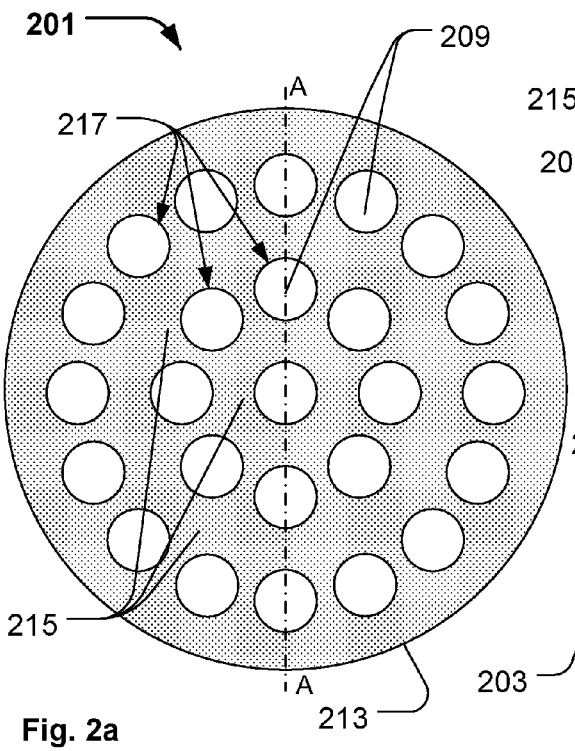
FIG. 2*a*-2*c* illustrate an embodiment of an illumination device according to the present invention.
Figure 2B:
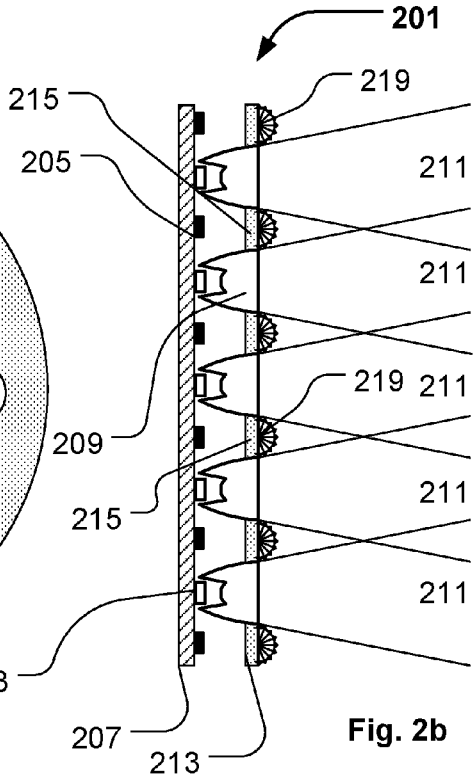
Figure 2C:
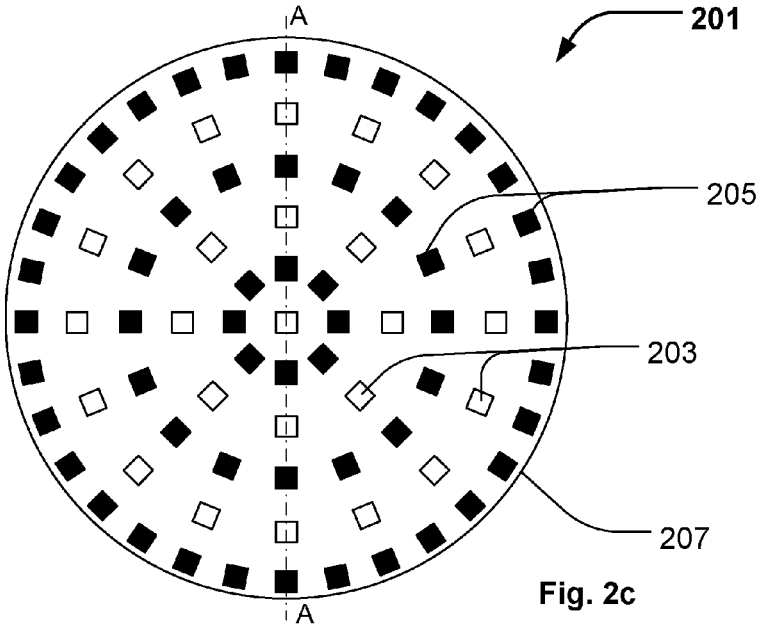

FIGS. 2*a*-*c* illustrate a simplified embodiment of the illumination device 201 according to the present invention. FIG. 2*a* illustrate a top view, FIG. 2*b* illustrates a cross sectional view along line A-A and FIG. 2*c* illustrates a top view with the diffuser cover and light collectors removed.

The illumination device 201 comprises a number of light sources arranged in a first group of light sources 203 (indicated as white quadrangles) and in a second group of light sources 205 (indicated as black quadrangles). The light sources are mounted on a PCB 207 (printed circuit board) and the two groups of light sources can be controlled individually for instance by a controller (not shown) as known in the art of lighting. The controller is thus adapted to treat the two groups of light sources as at least two individual light sources which can be individually controlled. However the skilled person realizes that the illumination device also can be adapted to divide each group of light sources into a number of sub-groups which also can be controlled individual and that it is also possible to control each single light source individually. A number of light collecting means 209 are arrange above and around the first group light sources 203 and is adapted to collect light from the first group of light sources and convert the collected light into a number of source light beams 211. The light collecting means 209 can be embodied as any optical component capable of collecting light from the light sources and convert the light into light beams and can for instance be optical lenses, light mixers, TIR lenses etc. In the illustrated embodiment the light collecting means 209 are embodied as TIR lenses as known in the prior art and the skilled person realizes that the TIR lens can be designed according the light output of the light source and the descried optical properties of the source light beam 211. The light beams 211 will merge into one large light beams as the distance to the illumination device increases.

The illumination device comprises a diffuser cover 213 arranged above the PCB 207 and the diffuser cover comprises at least one diffuser region 215 and at least one non-diffusing region 217. The diffuser regions receive 215 light generated by the second group of light sources 203 and diffuse the received light in many directions as illustrated by arrows 219. The consequence is that a new light effect can be created as the area between the light beams can have another color than the color of the light beams. This look can be dynamic if the first group of light sources and the second group of light sources are individually controlled as known in the art of entertainment lighting. The second group of light sources can also be adapted to emit light having substantially the same color as the light emitted by the first group whereby the surface of the illumination device appears as one surface having the same color. The diffusing regions can be arranged between the non-diffusing regions whereby the dotted look can be avoided as the areas between the non-diffusing regions now have substantially the same color as the light beams 211 exiting the illumination device through the non-diffusing regions.

The second group of light sources can functions as background lighting with own DMX control and both color and intensity can be varied independently of the first group of light sources. They can also be intensity and color linked with first target color in a predetermined manner or has separate control for contrast colors or other intensity. This adjustment/control of the light sources can be done remotely from a central control unit or at the fixture itself.

The illumination device can further comprise a number of predetermined effect functions defining a number of visual effects which can be activated by a user through an input signal e.g. from a central controller as known in the art of entertainment lighting. The effect functions can for instance be predetermined illumination patterns such as color effects, strobing effects, dimming effects or combination of these performed by the first and second group of light sources. The predetermined effect functions can activate instructions related to both the first and second group of light sources and also instructions related to how the first and second light sources are activated in relation to each other. The predetermined effect functions can be stored in a memory inside the illumination device and the controlling means can be adapted to access the predetermined effect functions from the memory and control the light sources based on the predetermined effect functions.

In order to provide the illumination device with further effects functions the controlling means is capable of activating at least two of the effect functions at the same time whereby the number of possible effects functions is increased as combination of at least two of the predetermined effect functions is possible. In other words the controlling means is adapted to control the first group of light sources and the second group of light sources based on an input signal indicative of at least a first effect function and at least a second effect function. When activating two effect functions at the same time the controlling means is further adapted to control the first and the second group of light sources based on a priority schema defining a relationship between first effect function and the second effect function. The priority schema can also be stored in the memory and comprises a number of instructions defining how the different effect functions acts when combined with another effect function. Further when activating two effect functions at the same time the controlling means is further adapted to control the first and the second group of light sources based on a synchronizing schema defining a time relationship between first effect function and the second effect function. The synchronizing schema can also be stored in the memory and comprises a number of instructions defining how the different effect functions acts when combined with another effect function. The priority schema and the synchronizing schema are described in further detail in connection with FIG. 5-FIG. 7

The present invention can for instance be integrated into the prior art illumination device illustrated in FIG. 1*a*-1*b* by arranging the second group of light sources between the original LEDs 124 at the LED PCB 123 and letting the light from these light sources be diffused by areas 126 of the lens holder 125 which are positioned between the lens holders 125. Further the controlling means is adapted to control the first and second group of light sources based on the predetermined effect functions, priority schema and/or a synchronization schema stored in the memory. Alternatively the light sources can be arranged as illustrated in FIG. 1*c* where the predefined effect functions define how the different groups (I-VI) of light sources are activated.

Figure 3B:
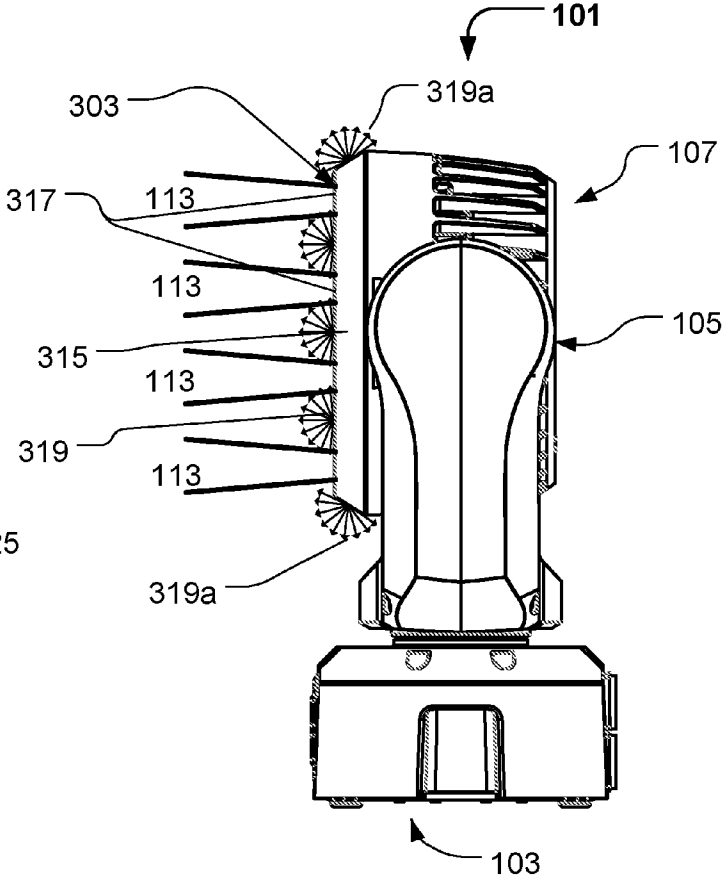
FIG. 3*a*-3*b* illustrate the illumination device of FIG. 1*a*-1*b* modified into an illumination device according to the present invention.
Figure 3A:
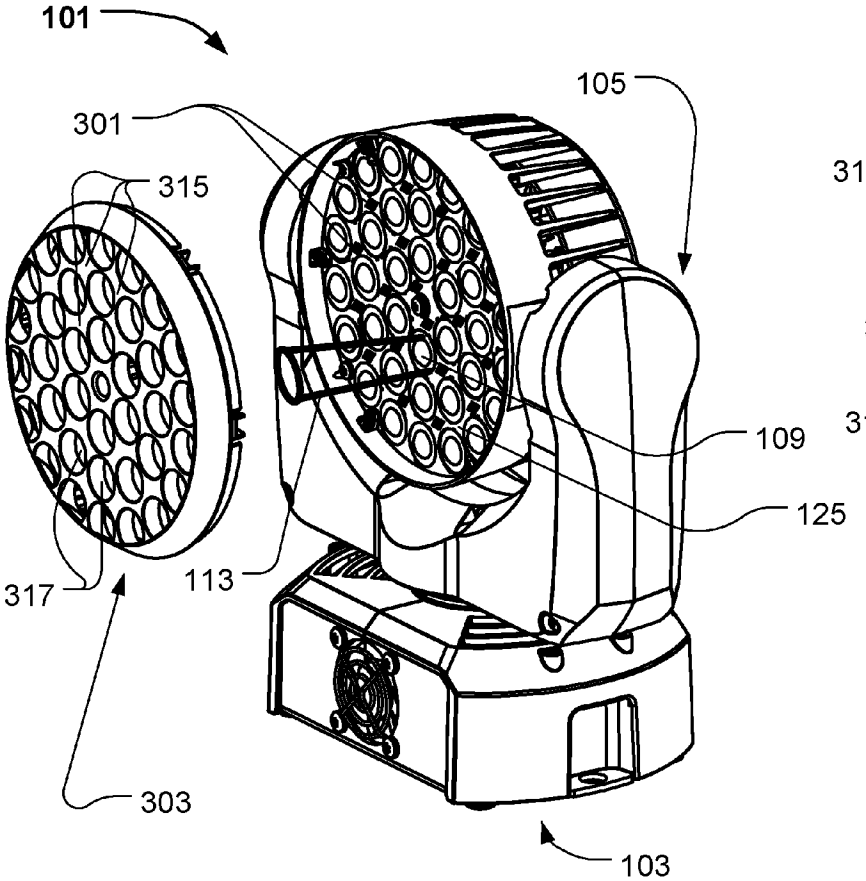

FIG. 3*a* and FIG. 3*b* is respectively a perspective view and a side view of the illumination device of FIG. 1*a*-1*b* which has been modified into an illumination device according to the present invention.

In this embodiment a number of LEDs 301 (illustrated as black quadrangles) have been mounted between the light collecting means and at the lens holder. This can for instance be achieved by embodying the lens holder as a PCB with a number of holes wherein the light collecting means can be arranged or by adding a PCB to the original lens holder. The original LEDs 124 (see FIG. 1*b*) and the added LEDs 301 and are adapted to function as respectively a first group and a second group of light sources that can be controlled individually.

Further the head housing comprises a diffuser cover 303 (exploded from the housing in FIG. 3*a* and mounted in FIG. 3*b*) comprising at least one diffuser region 315 and at least one non-diffusing region 317. The diffuser regions 317 receive at least a part of the light generated by the second group light sources and diffuses the received light as indicated by arrows 319 (only indicated on FIG. 1*b* for the sake of simplicity). At least at part of the number of source light beams 113 pass through the non-diffusing regions 315 without being diffused. It is to be noted that only some of the light source beams are illustrated for the sake of simplicity. The result is that the dotted LED front look is removed, by lighting up the diffuser cover as light is emitted from both the non-diffusing regions and diffusing regions and the areas between the lenses are illuminated with the existing internal stray light from the LEDs are diffused into the surroundings.

At least a part of the diffuser cover 303 protrudes from the housing and a part of the light is as a consequence diffused sideways and backwards (as indicated by arrows 319*a*) in relation to the source light beams. The diffusing regions of the diffuser cover can be lit up both from behind the surface and from the side and thereby function as a light guide. The light fixture can as a consequence be viewed from multiple angles and the protruding diffuser cover provides a new light effect to the light fixture.

The non-diffusing regions can be embodied as clear areas like plane transparent surfaces arranged above the light collecting means. Such clear plane transparent surfaces will allow the light source beams to pass without diffusing the light source beams. However the clear areas can be adapted to adjust the beam divergence of the light source light beam, but the outgoing light beam will still be a well defined light beam. The diffuser cover can thus be embodies in clear polymer where the diffusing regions are created by etching the surface of the diffuser cover. The diffusing region can also be created by coating the regions where the diffusing region is to be positioned. The diffusing cover can further be molded where the molds are adapted to define the non-diffusing regions and the diffusing regions. The non-diffusing regions can also be embodied as aperture or cut outs arranged above said light collecting means.

The diffuser cover can also comprise fastening means which enables a user to attach a diffuser cover to an illuminating device. The diffuser cover can thus be provided as a standard component or as an optional accessory.

Figure 4A:
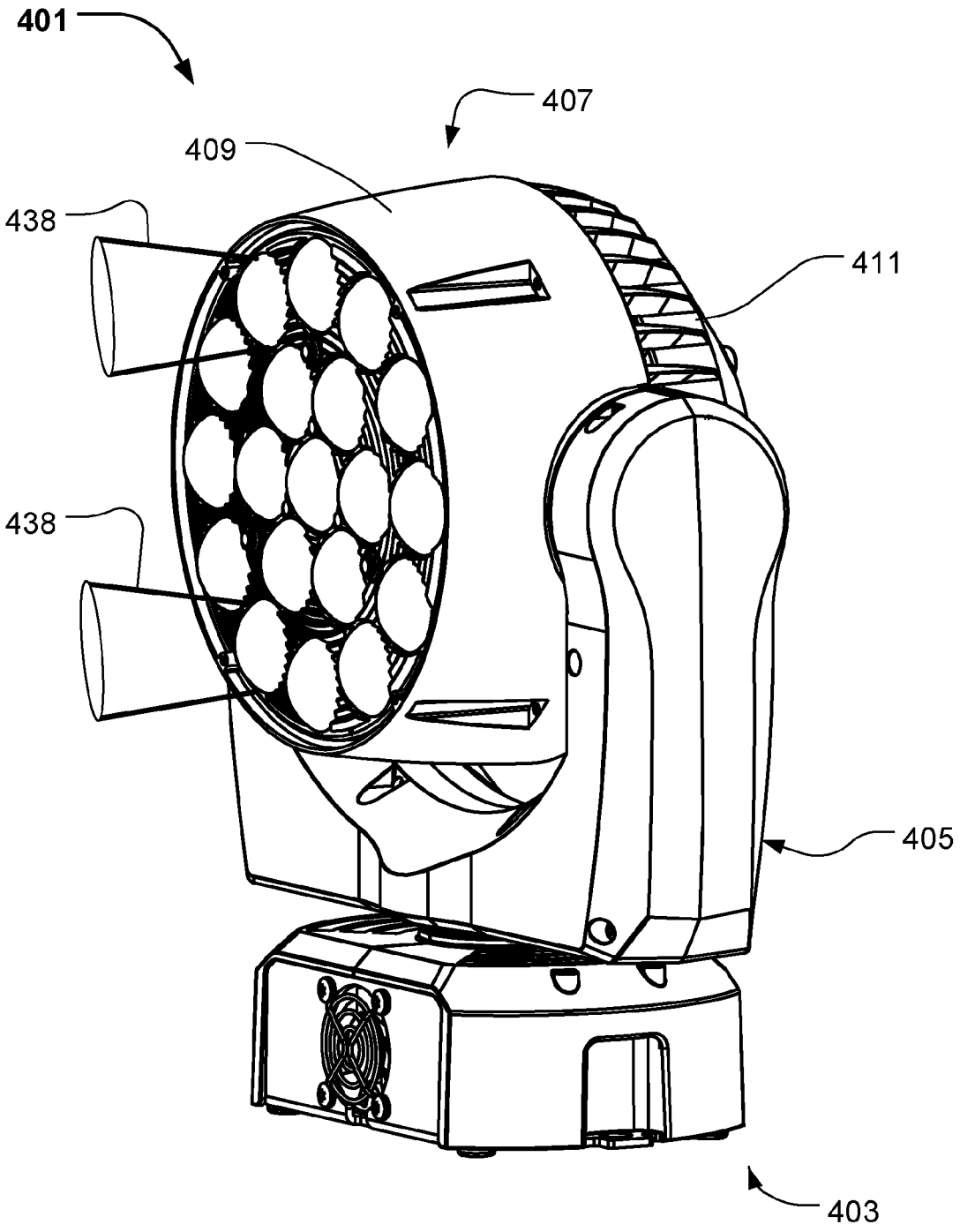
FIG. 4*a*-4*c* illustrate another embodiment of an illumination device according the present invention.
Figure 4B:
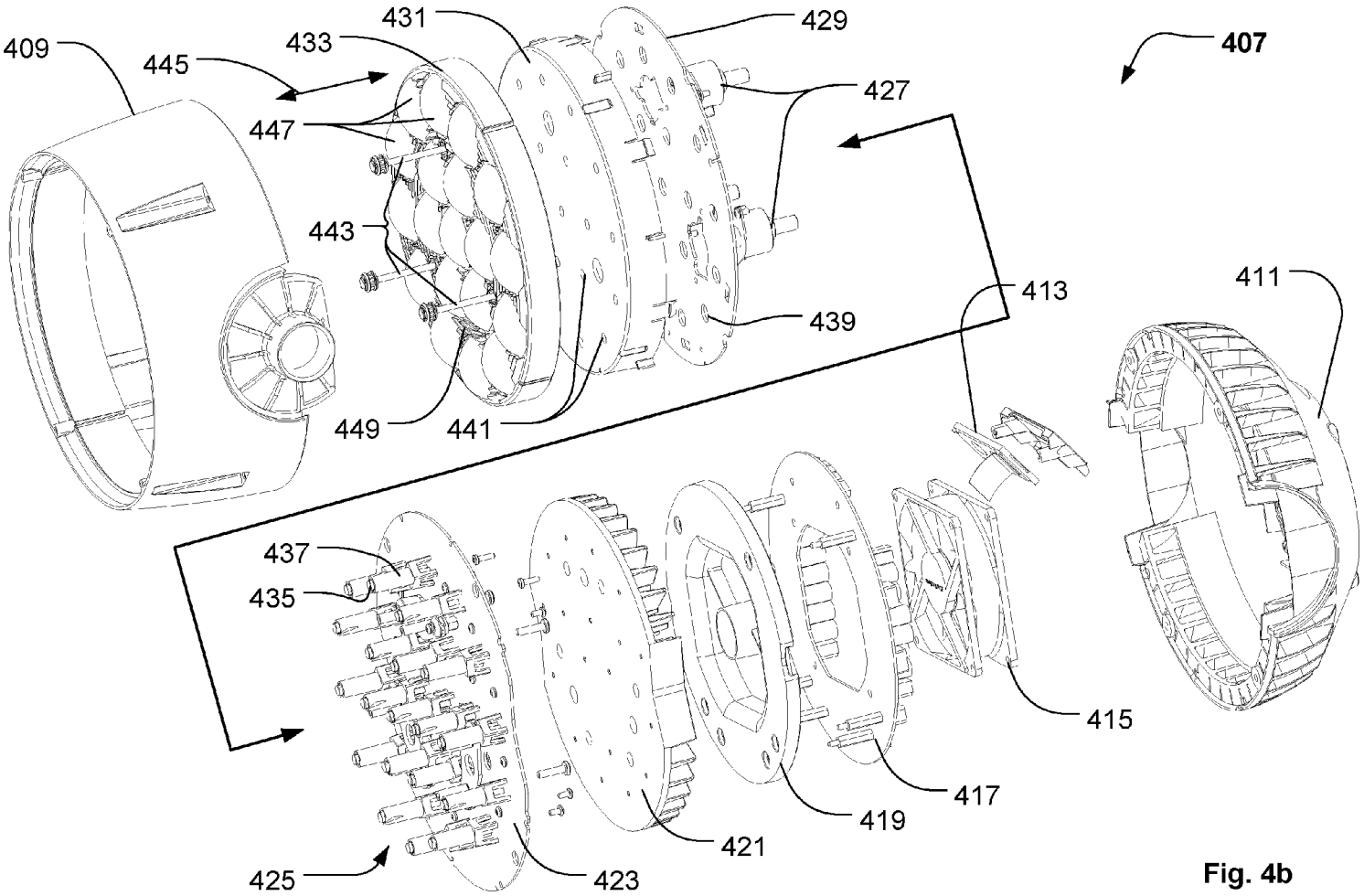
Figure 4C:
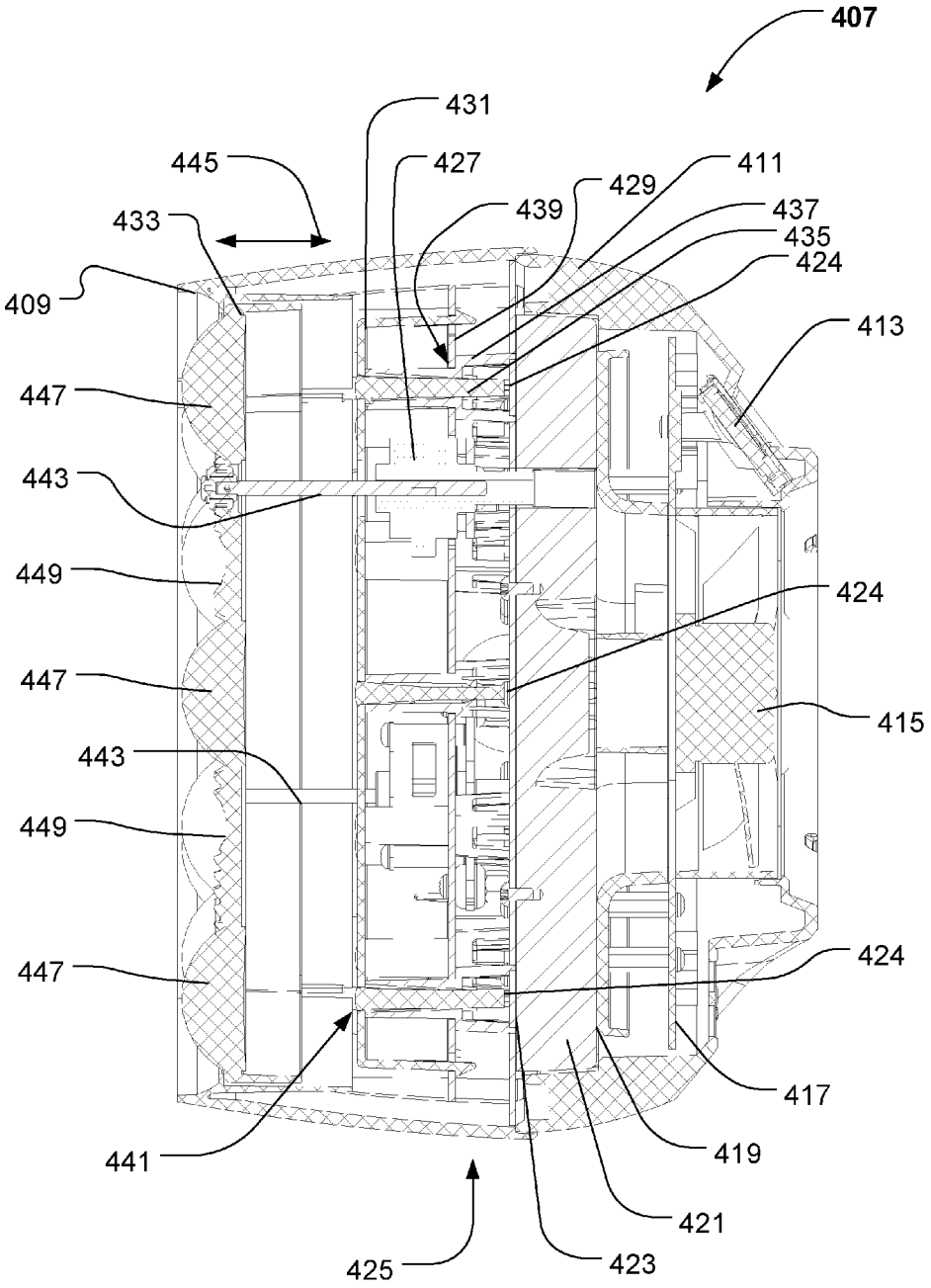

FIG. 4*a*-4*c* illustrates another embodiment of an illumination device accordion the present invention; where FIG. 4*a* is a perspective view, FIG. 4*b* is an exploded view of the head and FIG. 4*c* is a cross sectional view of the head. The illumination device is a moving head lighting fixture 401 comprising a base 403, a yoke 405 rotatable connected to the base and a head 407 rotatable connected to the yoke 405.

In the illustrated embodiment the head 407 comprises a front housing 409 and a rear housing 411 that are interconnected and constitutes the head housing. The following components are arranged inside the head housing:

a display 413 (visible from the rear side of the head)
a fan 415
a main PCB 417
an air guide 419
a heat sink 421
a first LED PCB 423
a light collecting assembly 425
a number of zoom motors 427
a second LED PCB 429
a diffusing cover 431
a zoom lens 433

The fan is adapted to blow air from the rear side of the housing through the main PCB 413 and the air guide 419. The air guide is adapted to guide the blown air to the center part of the heat sink 421 where after the air escapes the housing in a radial direction. As a consequence heat can be dissipated away from the first LED PCB 423. The first LED PCB 423 comprises a number of first type LEDs 424 (only shown in FIG. 4*c*) arranged in a first group of LEDs. The light collecting assembly 425 comprises a number of light collecting means 435 arranged in holding means 437 and each holding means 437 is adapted to position each light collecting means above one of the first type LEDs. In this embodiment the first type LEDs are 4 in 1 RGBW LEDs which comprises a red die, green die, blue die and a white die and each light collecting means is adapted to collect and mix the light from the first type LEDs and convert the collected light into a light beam. A number of light beams 438 (only shown in FIG. 4*a*) will thus be created by the first type LEDs and light collectors. The light collectors can for instance be embodied as described in the patent applications DK PA 2010 70580 filed 23, Dec. 2010 or PCT/DK2011/050450 filed 25, Nov. 2011 by the applicant and incorporated herein by reference.

The second LED PCB 429 is arranged above the first LED PCB 423 at the lower part of the holding means 437. The LED PCB comprises a number of a second type LEDs (not shown) and a number of holes 439 where through the light collecting means 435 and the upper part of the holding means 437 can pass. In this embodiment the second type LEDs are 4 in 1 RGBW LEDs which comprises a red die, green die, blue die and a white die. Compared to the first type of LEDs the second type of LEDs is low power LEDs and requires as a consequence less cooling. However the skilled person that it will realize that it is possible to let the second type LED be the identical to the first type of LEDs.

The diffusing cover 431 is arranged above the second LED PCB 429 and comprises a number of non-diffusing regions embodied as holes 441 wherein the top of the light collection means 435 are arranged and the light beams generated by the first type LEDs will thus pass through the diffusing cover without being diffused. In contrast hereto the light from the second type LEDs will hit the diffusing cover 431 and be diffused and as a consequence the diffusing cover 431 appears as one illuminating surface.

The illumination device comprises also a zoom lens 433 which is connected to a number to the zoom motors 427 through a number of rods 443, which can be moved back and forth the by the zoom motors 427 as illustrated by arrow 445. In this embodiment the zoom lens comprises a number of optical lenses 447 and each optical lens 447 is adapted to change the divergence of the light beams exiting the light collecting means. The consequence is that the divergence of the light beams can be changed by moving the zoom lens back and forth. The zoom lens is embodied as one transparent solid body for instance polymer or plastic and the will appear as one illuminating surface as the diffused light will pass through the zoom lens. The areas between the optical lenses 447 is provided with angled surfaces 449 which prevents light from the surroundings to be reflected in the same direction which makes the illumination device nicer to look at. It is to be understood that the zoom lens can be embodied in many different ways for instance as one common optical lens. Further it is to be understood that the zoom lens also can be embodied as the diffusing cover where the areas 449 between the optical lenses 447 can be adapted to receive and diffuse the light generated by the second type light sources. As consequence and in such embodiment the diffuser cover 431 can be omitted.

The yoke and base can be embodied as known in prior art for instance as described in FIG. 1*a*-1*b*. However the skilled person will be able to construct these parts in many different ways.

Figure 5:
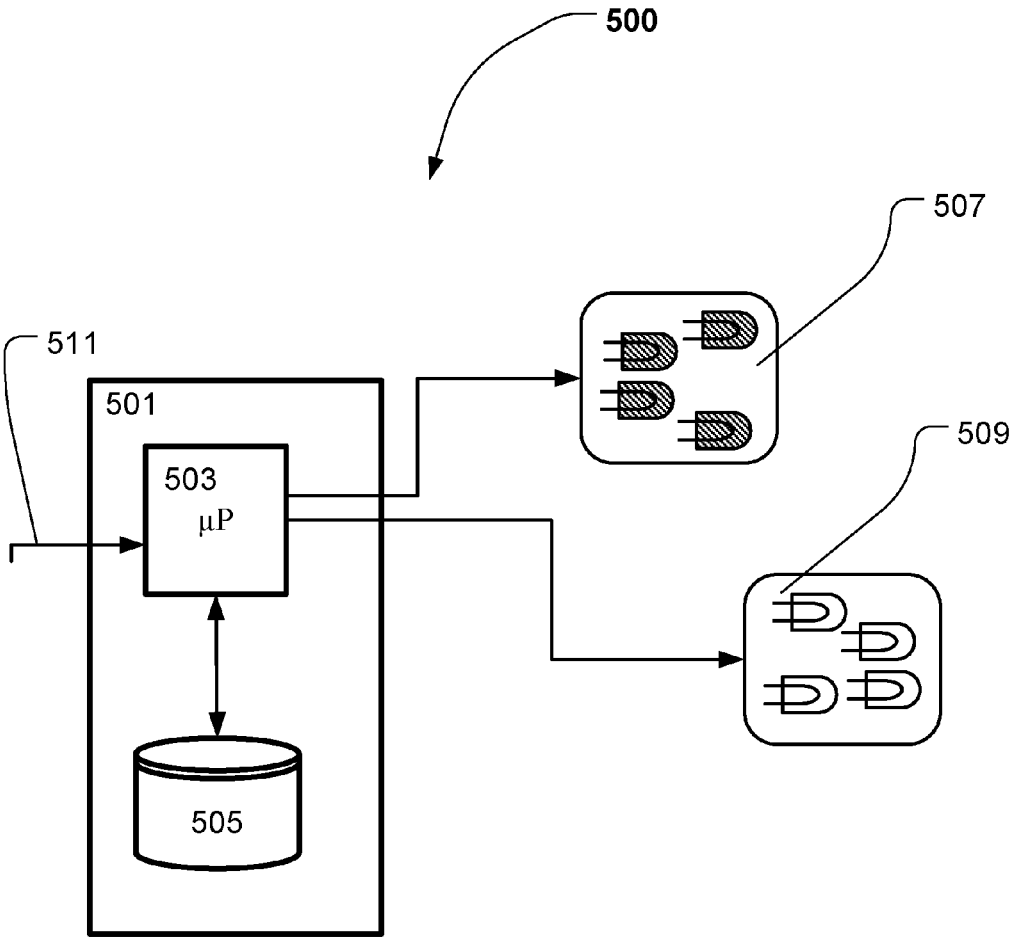
FIG. 5 illustrates a block diagram of a illumination device according to the present invention.

FIG. 5 illustrates a block diagram of the illumination device 500 according the present invention. The illumination device comprises a control unit 501 comprising a processor 503 and a memory 505. The first group of light sources 507 and the second group of light sources 509 is connected to the control unit 501. The processor acts as controlling means and is adapted to control the first group of light sources 507 and the second group of light sources individually. Meaning the processing means can control one of the groups of light sources without controlling the other group of light sources. The controlling can for instance adapted to control the color and/or intensity of the light sources and can be based on any type of communication signals known in the art of lightning e.g. PWM, AM, FM, DC, binary signals etc. The first 507 and second 509 groups of light sources can thus be controlled individually and independently of each other can thus be treated as two individually and independent groups of light sources. It is to be understood that the individually light sources of each groups can be controlled by the same control signal, supplied with individual control signals and/or grouped in sub-groups where each subgroup receive the same control signal. The controlling means is further adapted to control the groups of light sources based on an input signal 511 indicative of a number of control parameters.

The control parameters may be indicative of color, intensity, strobe frequency, related to the groups of light sources. The color parameter can for instance define the color of the light that the different groups of light sources shall generate, for instance RGB values, color coordinates in color maps etc. The intensity parameter can for instance define a dimmer level related to the different groups of light sources and/or define dimmer curve which need to be used when dimming. A strobe frequency may define how fast the different groups should strobe. The control parameters may also be indicative of pan and tilt movement of the head and yoke and/or zoom level (if illumination device comprises a zoom function like the illumination device illustrated in FIG. 4*a*-4*c*.)

The input signal 511 can be any signal capable of communication parameters and can for instance be based on one of the following protocols USITT DMX 512, USITT DMX 512 1990, USITT DMX 512-A, DMX-512-A including RDM as covered by ANSI E1.11 and ANSI E1.20 standards or Wireless DMX. ACN designates Architecture for Control Networks; ANSI E1.17-2006 or any other control protocols.

The input signal is also indicative of a number of effect functions related to the first and/or second group of light sources. The effect functions define a number of preprogrammed effects which can be executed automatically by calling the effect function through the input signal and the controlling means will then control the different groups of light sources based on the called effect function. The input signal can be also indicative of an effect function adjustment parameter which relates the execution of respectively the effect function. For instance the adjustment parameter can be indicative of an execution speed of an effect function which increases or decreases the time period of the effect function. The adjustment parameter can also be indicative of a number of other parameters related to the effect function. The effect functions make it easier for a light programmer and/or light designer to create different visual effects.

A number effect functions are described in the tables below where:

Input indicate the input parameters that effect function uses when generating the effect. The input parameters are indicated by the input signal and the controlling means uses the input parameters when generating the effect function;

Output indicates the output the effect function. The output is generated by the effect function based on the input parameters.

Effect rules indicates what the controlling means does with other input parameters which normally are affected by the output of the effect function.

Description is a description of the effect function describing how its output is generated and which visual effect created by the effect function.

| Effect name | Dimmer synchronization |
|---|---|
| Input | A first dimmer parameter related to the first group of light sources. |
| Output | The dimming of the second group of light sources is controlled based on the first dimmer parameter. |
| Effect rules | An eventual second dimmer parameter related to the second group of light sources is ignored by the controlling means. |
| Description | Any dimmer settings for the first group of light sources are applied to the second group of light sources. First and second group of light sources act thus in sync when the dimmer is changed. |

| Effect name | Strobe Synchronization |
|---|---|
| Input | A first strobe parameter related to the first group of light sources. |
| Output | Strobing of the second group of light sources is based on the first strobe parameter. |
| Effect rules | An eventual second strobe parameter relate to the second group of light sources is ignored by the controlling means. |
| Description | Any strobe settings for the first group of light source are applied to the second group of light sources. The strobing of the first group and second group of light sources are in sync. |

| Effect name | Dimmer synchronization + Strobe synchronization |
|---|---|
| Input | A first dimmer parameter and a first strobe parameter related to the first group of light sources. |
| Output | Dimming and strobing of the second group of light sources are performed based on the first dimmer parameter and the first strobe parameter. |
| Effect rules | An eventual second dimmer parameter and an eventual second strobing parameter related to the second group of light sources through are ignored by the controlling means. |
| Description | Any dimmer settings and strobing setting for the first group of light sources are applied to the second group of light sources. The dimming effect and strobing effect of the first group and second group are respectively in sync. |

| Effect name | Color synchronization |
|---|---|
| Input | First color parameter(s) related to the first group of light sources. |
| Output | Color adjustment of the second group of light sources is performed based on the first color parameter(s) related to the first group of light sources. |
| Effect rules | Second color parameter(s) related to the second group of light sources is ignored by the controlling means. |
| Description | Any color settings for the first group of light sources are applied to the second group of light sources and the two group of light sources act in color sync. In other words the color of the second group of light sources are identical to the color of the first group of light sources. |

| Effect name | All Synchronization. |
|---|---|
| Input | First dimmer parameter, first strobe parameter, and first color parameter(s) all related to the first group of light sources. |
| Output | Dimming, strobing and coloring of the second group of light sources are controlled based on the first dimmer parameter, the second strobe parameter and the first color parameter(s). |
| Effect rules | Second dimmer parameter, second strobe parameter and second colors parameter(s) all related to the second group of light sources are ignored by the controlling means. |
| Description | Any dimmer settings, strobing setting and color setting for the first group of light sources are applied to the second group of light sources. The first and second groups of light source are thus in sync. |

| Effect name | Color offset |
|---|---|
| Input | First color parameter(s) related to the first group of light sources and a color offset parameter. |
| Output | Color adjustment of the second group of light sources is performed based on the first color parameter related to the first group of light sources and the color offset parameter. |
| Effect rules | Second color parameter(s) related to the second group of light sources is ignored by the controlling means. |
| Description | The color of the second group of light sources can be set as an offset of the color of the first group of light sources, where the offset for instance defines a degree value of the color circle. The color of the second group of light sources will thus be regulated in sync with the color of the first group of light sources but within an offset on the color circle. The offset can be set between −180 degrees and +180 degrees. |

| Effect name | Strobe delay |
|---|---|
| Input | A first strobe parameter related to the first group of light source and a first delay parameter related to the strobe delay function. |
| Output | Strobing of the second group of light sources is based on the first strobe parameter and the first delay parameter. |
| Effect rules | A second strobe parameter relate to the second group of light sources is ignored by the controlling means. |
| Description | Any strobe settings for the first group of light source are applied to the second group of light sources but adjusted according the first delay parameter. The delay parameter adjusts the starting time of the strobing of the second group of light sources relatively to the starting time of the strobing of the first group of light sources. In other words the strobe delay effect function strobes the first and second group of light sources at the same frequency, however the strobing of the two groups of light sources can be delayed in relation to each other. |

| Effect name | Color strobe of first group |
|---|---|
| Input | First color parameter(s) related to the first group of light sources; a first color strobe parameter related to the color strobe of first group effect function;<br>a first strobe parameter related to the first group of light sources. |
| Output | Strobing of the first group of light sources are based on the first strobe parameter, and the color of the first group of light sources and the first color strobe parameter; |

-continued

| Effect name | Color strobe of first group |
|---|---|
| Effect rules | None |
| Description | The color of the first group of light sources changes between a main color defined by the first color parameter and a strobe color defined by the first color strobe parameter while strobing at a frequency defined by the first strobe parameter. The first color strobe parameter can define an exact strobe color or an offset of the main color defining a degree value of the color circle. |

| Effect name | Color strobe of second group |
|---|---|
| Input | Second color parameter(s) related to the second group of light sources;<br>a second color strobe parameter related to the color strobe of second group effect function;<br>a second strobe parameter related to the second group of light sources. |
| Output | Strobing of the second group of light sources are based on the second strobe parameter, and the color of the second group of light sources and the second color strobe parameter; |
| Effect rules | None |
| Description | The color of the second group of light sources changes between a main color defined by the second color parameter(s) and a strobe color defined by the second color strobe parameter while strobing at a frequency defined by the second strobe parameter. The second color strobe parameter can define an exact strobe color or an offset of the main color defining a degree value of the color circle. |

| Effect name | Intensity pulse alternate |
|---|---|
| Input | A first dimmer parameter related to the first group of light sources and an intensity pulse alternate parameter. |
| Output | Dimming of both first and second groups of light sources are performed based on the first dimmer parameter and the intensity pulse alternate parameter. |
| Effect rules | Second dimming parameter(s) related to the second group of light sources is ignored by the controlling means. |
| Description | The controlling means is adapted to perform a sinewave crossfading between the first and second group of light sources. The first dimming parameter defines the maximum dimming level and the intensity pulse alternate parameter defines the period length of the sinewave. In other words the first and second group of light sources are dimmed between the maximum dimming level defined by the first dimming parameter and zero using a sinewave where the sinewave of the second group of light sources are displaced half at period in relation to the sinewave of the first group. |

| Effect name | Intensity toggle alternate |
|---|---|
| Input | A first dimmer parameter related to the first group of light sources;<br>A second dimmer parameter related to the second group of light sources;<br>and an Intensity Toggle parameter. |
| Output | The dimmer level of the first group of light sources is controlled based on the first dimmer parameter and the intensity toggle parameter;<br>The dimmer level of the second group of light sources is controlled based on the second dimmer parameter and the intensity toggle parameter; |
| Effect rules | Strobe parameters related to the first and second group of light sources are ignored by the controlling means. |
| Description | The controlling means is adapted to toggle between having the first group of light sources activated at a dimmer level defined by the first dimmer parameter and having the second group of light sources activated at a dimmer level defined by the second dimmer parameter. The second group of light sources is turned off while the first group of light sources is on and the first group of light sources is turned off while the second group of light sources is turned on.<br>The toggle intensity parameter is indicative of the toggling speed, and the toggling speed can thus be regulated based on the toggle intensity parameter. |

| Effect name | Intensity random alternate |
|---|---|
| Input | A first dimmer parameter related to the first group of light sources;<br>a second dimmer parameter related to the second group of light sources;<br>and<br>an intensity random alternate parameter. |
| Output | Dimming of the first group of light sources is based on the first dimming parameter and dimming of the second group of light sources is based on the second dimming parameter. The dimming of both the first and intensity random alternate parameter. |
| Effect rules | none |
| Description | The controlling means is adapted to fade between having the first group of light sources activated at a dimmer level defined by the first dimmer parameter and having the second group of light sources activated at a dimmer level defined by the second dimmer parameter. The second group of light sources is fades off while the first group of light sources fades on and the first group of light sources is fades off while the second group of light sources fades on.<br>The intensity random alternate is indicative of the a maximum fading time, however the fading time is determined randomly by the controlling means. |

| Effect name | Zoom Pulse |
|---|---|
| Input | zoom parameter related to a zoom module of the light fixture and a zoom speed parameter related to the zoom pule function. |
| Output | The zoom module is controlled based on the zoom parameter, the zoom speed parameter and the base zoom level. |
| Effect rule | The initially position of the zoom module is used as a base zoom level |
| Description | The zoom module performs a sawtooth fade around the base zoom level,<br>The zoom parameter defines the zoom range zoom related to the base zoom level between −50% and +50%.<br>The zoom speed parameter defines the speed of the pulse. |

| Effect name | Zoom ramp up |
|---|---|
| Input | A minimum zoom parameter related to a zoom module and a zoom speed parameter related to the zoom ramp up function. |

-continued

| Effect name | Zoom ramp up |
|---|---|
| Output | The zoom module is controlled based on the minimum zoom parameter, the zoom speed parameter and the base zoom level. |
| Effect rules | The initially position of the zoom module is used as a base zoom level |
| Description | The Zoom module performs a ramp up from the minimum zoom parameter to the base zoom level,<br>The zoom speed parameter defines the speed of the ramp up effect. |

| Effect name | Zoom ramp down |
|---|---|
| Input | A minimum zoom parameter related to a zoom module and a zoom speed parameter related to the zoom ramp down function. |

-continued

| Effect name | Zoom ramp down |
|---|---|
| Output | The zoom module is controlled based on the minimum zoom parameter, the zoom speed parameter and the base zoom level. |
| Effect rules | The initially position of the zoom module is used as a base zoom level |

-continued

| Effect name | Zoom ramp down |
|---|---|
| Description | The Zoom module performs a ramp down from the base zoom level to the minimum zoom parameter.<br>The zoom speed parameter defines the speed of the ramp down effect. |

| Effect name | Intensity second to first ramp |
|---|---|
| Input | First dimmer parameter related to the first group of light sources; second dimmer parameter related to the second group of light sources; speed parameter related to the intensity second to first ramp |
| Output | The dimming of the first group of light sources is controlled based on the first dimmer parameter and the dimming of the second group of light sources are controlled based on the second dimmer parameter. The dimming speed of the first and second group of light sources is regulated based on the speed parameter. |
| Effect rules | none |
| Description | The controlling means is adapted to start the intensity second to first ramp effect by setting:<br>Dimmer level of the first group of light sources to zero; and the dimmer level of the second group of light sources according to the second dimmer parameter.<br>The first group of light sources is then dimmed to the first dimmer level defined by the first dimmer parameter and simultaneously the second group of light sources is dimmed to zero<br>Finally the first group of light sources is snapped back to zero and the second light sources is snapped back to the second dimmer level according to the second dimmer parameter.<br>Speed parameter defines the speed of the dimming step. |

| Effect name | Intensity first to second ramp |
|---|---|
| Input | First dimmer parameter related to the first group of light sources; second dimmer parameter related to the second group of light sources; speed parameter related to the intensity first to second first ramp |
| Output | The dimming of the first group of light sources is controlled based on the first dimmer parameter and the dimming of the second group of light sources is controlled based on the second dimmer parameter. The dimming speed of the first and second group of light sources is regulated based on the speed parameter. |
| Effect rules | none |
| Description | The controlling means is adapted to start the intensity first to second ramp effect by setting:<br>Dimmer level of the first group of light sources to the dimmer level according to the first dimmer parameter; and set the dimmer level of the second group to zero.<br>The first group of light sources is then dimmed to zero and simultaneously the second group of light sources is dimmed to the dimmer level according to the second dimmer parameter.<br>Finally the first group of light sources is snapped back to the dimmer level according to the first dimmer parameter and the second light sources is snapped back zero.<br>Speed parameter defines the speed of the dimming step. |

| Effect name | second ramp, first flash |
|---|---|
| Input | First dimmer parameter related to the first group of light sources; second dimmer parameter related to the second group of light sources; speed parameter related to the second ramp, first flash function |
| Output | The dimming of the first group of light sources is controlled based on the first dimmer parameter and the dimming of the second group of light sources is controlled based on the second dimmer parameter. The dimming speeds of the first and second group of light sources are both regulated based on the speed parameter. |
| Effect rules | First and second strobe parameters are ignored by the controlling means. |

-continued

| Effect name | second ramp, first flash |
|---|---|
| Description | The controlling means is adapted to start the second ramp, first flash effect by:<br>Setting Dimmer level of the first group and second group of light sources to zero.<br>The second group of light sources is then dimmed to the dimmer level according the second dimmer parameter while the dimmer level of the first group of light sources are kept at dimmer level zero.<br>Finally the second group of light sources is snapped back to dimmer level zero and simultaneously the first group of light sources provides a single flash at the dimmer level according to the first dimmer parameter.<br>The speed parameter adjusts to total period time of the function. |

| Effect name | first ramp, second flash |
|---|---|
| Input | First dimmer parameter related to the first group of light sources; second dimmer parameter related to the second group of light sources; speed parameter related to the first ramp, second flash function |
| Output | The dimming of the first group of light sources is controlled based on the first dimmer parameter and the dimming of the second group of light sources is controlled based on the second dimmer parameter. The dimming speeds of the first and second group of light sources are both regulated based on the speed parameter. |
| Effect rules | First and second strobe parameters are ignored by the controlling means. |
| Description | The controlling means is adapted to start the first ramp, second flash effect by:<br>Setting dimmer level of the first group and second group of light sources to zero.<br>The first group of light sources is then dimmed to the dimmer level according the first dimmer parameter while the dimmer level of the second group of light sources are kept at dimmer level zero.<br>Finally the first group of light sources is snapped back to the dimmer level zero and simultaneously the second group of light sources provides a single flash at the dimmer level according to the second dimmer parameter.<br>The speed parameter adjusts to total period time of the function. |

| Effect name | Strobe alternate single |
|---|---|
| Input | First strobe parameter related to first group of light sources; second strobe parameter related to second group of light sources. |
| Outputs | Strobing of the first and second group of light sources are controlled based on the first and second strobe parameters. |
| Priority | None |
| Description | The controllisng means are adapted to alternate between strobing the first group of light sources at a strobe rate defined by the first strobe parameter and strobing the second group of light sources based on the second strobe parameter.<br>The strobe alternate single effect function provides one flash from the first group of light sources followed by one flash from the second group of light sources. |

| Effect name | Strobe alternate dual |
|---|---|
| Description | Like the strobe alternate single functions; however the Strobe alternate dual effect function provides two flashes from the first group of light sources followed by two flashes from the second group of light sources. |

| Effect name | Strobe alternate triple |
|---|---|
| Description | Like the strobe alternate single functions; however The Strobe Alternate triple effect function provides three flashes from the first group of light sources followed by thee flashes from the second group of light sources. |

| Effect name | Strobe alternate single with pause |
|---|---|
| Input | First strobe parameter related to first group of light sources;<br>second strobe parameter related to second group of light sources;<br>A pause parameter related to the strobe alternate single with pause |
| Output | Strobing of the first and second group of light sources are controlled based on the first and second strobe parameters. |

-continued

| Effect name | Strobe alternate single with pause |
|---|---|
| Effect rules | None |
| Description | The controlling means are adapted to alternate between strobing the first group of light sources at a strobe rate defined by the first strobe parameter and strobing the second group of light sources based on the second strobe parameter followed by a period with no strobing.<br>The strobe alternate single with pause effect function provides one flash from the first group of light sources followed by one flash from the second group of light sources and does then insert a pause with no flashes. The length of the pause can be regulated by the pause parameter. |

| Effect name | Strobe alternate triple with pause |
|---|---|
| Description | Like the strobe alternate triple with pause function; however the she strobe alternate triple with pause effect function provides three flashes from the first group of light sources followed three flashes from the second group of light sources and does then insert a pause with no flashes.<br>The length of the pause can be regulated by the pause parameter. |

| Effect name | color zoom in ramp |
|---|---|
| Input | First color parameters related to the first group of light sources where the first color parameters comprises a first start color parameter(s) and a first end color parameter(s);<br>A minimum zoom parameter and a zoom speed parameter. |
| Output | The color of the first group light sources is controlled based on the first start color parameter and the first end color parameter. The zoom module is controlled based on the minimum zoom parameter, the zoom speed parameter and the base zoom level. |
| Effect rules | The initial zoom level is used as base zoom level |
| Description | The zoom module is moved from the base zoom value to the minimum zoom level defined by the minimum zoom parameter.<br>At the same time the color of the first light sources is gradually changed from the color indicated by the first start color parameter(s) to the color indicated by the first end color parameter(s).<br>Gradually changes can mean that the colors of the first light sources gradivally changes according to a predefined function from the first start color to the first end color. The predefined changing function can for instance be defined as a straight line between the start and end color in a color circle or as any curve in a color map connecting the start color with the end color.<br>Both zoom and color of the first light sources snap back to their start values at the same time.<br>The zoom speed parameter defines the period time for the effect. |

| Effect name | Color zoom in Fade |
|---|---|
| Input | Like Color zoom in ramp function |
| Output | Like Color zoom in ramp function |
| Effect rules | Like Color zoom in ramp function |

-continued

| Effect name | Color zoom in Fade |
|---|---|
| Description | Like color zoom in ramp function but with the difference that first part of the function is reversed instead of snapping the zoom and color of the first light sources back their start values. |

| Effect name | Color zoom out ramp |
|---|---|
| Input | First color parameters related to the first group of light sources where the first color parameters comprises a first start color parameter(s) and a first end color parameter(s);<br>a minimum zoom parameter and a zoom speed parameter. |

-continued

| Effect name | Color zoom out ramp |
|---|---|
| Output | The color of the first group light sources is controlled based on the first start color parameter and the first end color parameter. The zoom module is controlled based on the minimum zoom parameter, the zoom speed parameter and the base zoom level. |
| Effect rules | The initial zoom level is set as base zoom level. |
| Description | The zoom module is moved from the minimum zoom level defined by the minimum zoom parameter to the base zoom level.<br>At the same time the color of the first light sources is gradually changed from the color indicated by the first start color parameter(s) to the color indicated by the first end color parameter(s).<br>Gradually changes can mean that the colors of the first light sources gradually changes according to a predefined function from the first start color to the first end color. The predefined changing function can for instance be defined as a straight line between the start color and end color in a color circle or as any curve in a color map connecting the start color with the end color.<br>Both zoom and color of the first light sources snap back to their start values at the same time.<br>The zoom speed parameter defines the period time for the effect. |

| Effect name | Color zoom out fade |
|---|---|
| Input | Like color zoom out ramp function |
| Output | Like color zoom out ramp function |
| Effect rules | Like color zoom out ramp function |
| Description | Like color zoom out ramp function but with the difference that first part of the function is reversed instead of snapping the zoom and color of the first light sources back their start values. |

| Effect name | Hue Shimmer first group |
|---|---|
| Input | First color parameter related to the first group of light sources; a hue deviation parameter. |
| Output | The color of the first group of light sources are controlled based on the first color parameter and the first hue deviation parameter. |

| Effect name | Second saturate |
|---|---|
| Input | First color parameter(s) related to the first group of light sources;<br>A saturation parameter |
| Output | The color of the first group light sources is controlled based on the first color parameter and the color of the second group light source is controlled based on the first color parameter(s) and the saturation parameter. |
| Effect rules | Second color parameter(s) related to the second group of light sources are ignored by the controlling means. |
| Description | The color of the first group of light sources are identical to the color defined by the first color parameters, and the color of the second group light sources are defined as the color defined by the first color parameters, however the saturation have been increased by an amount indicated by the saturation parameter. |

| Effect name | Second desaturation |
|---|---|
| Input | First color parameter related to the first group of light sources;<br>A desaturation parameter |
| Output | The color of first group of light sources is controlled based on the first color parameter and the color of the second group of light source is controlled based on the first color parameter(s) and the desaturation parameter. |
| Effect rules | Second color parameter(s) related to the second group of light sources are ignored by the controlling means |
| Description | The color of the first group of light sources are identical to the color defined by the first color parameters, and the color of the second group light sources is defined as the same color defined by the first color parameters, however the saturation have been decreased by an amount indicated by the desaturation parameter. |

-continued

| Effect name | Hue Shimmer first group |
|---|---|
| Effect rules | None |
| Description | The hue shimmer first group function adjusts the hue of the first color parameter before applying the color to the first group light sources. The hue is changed randomly according the hue deviation parameter, which defines a maximum change in hue. The function is repeated at random time.<br>If the first color parameter is keep constant the result would be a visual effect where the hue of the color are randomly changed resulting in a hue shimmer effect. |

| Effect name | Hue shimmer second group |
|---|---|
| Description | Similar the Hue shimmer first group but applied to the second group of light sources. |

| Effect name | Saturation shimmer first group |
|---|---|
| Input | First color parameter related to the first group of light sources; a saturation deviation parameter. |
| Output | The color of the first group of light sources is controlled based on the first color parameter and the first saturation deviation parameter. |
| Effect rules | None |
| Description | The saturation shimmer first group function adjusts the saturation of the first color parameter before applying the color to the first group light sources. The saturation is changed randomly according the saturation deviation parameter, which defines a maximum change in saturation. The function is repeated at random time. If the first color parameter is keep constant the result would be a visual effect where the saturation of the color are randomly changed resulting in a saturation shimmer effect. |

| Effect name | Saturation shimmer second group |
|---|---|
| Description | Similar the saturation shimmer first group but applied to the second group of light sources. |

| Effect name | Hue and Saturation Shimmer first group |
|---|---|
| Input | First color parameter related to the first group of light sources; a first hue deviation parameter;<br>a first saturation deviation parameter. |
| Output | The color of the first group of light sources is controlled based on the first color parameter, the first saturation parameter and the firs hue deviation parameter. |
| Effect rules | None |
| Description | The hue and saturation shimmer first group function adjusts the saturation and hue of the first color parameter before applying the color to the first group light sources. The saturation and hue are changed randomly according the saturation deviation parameter and the hue deviation parameter, which respectively defines a maximum change in saturation and hue. The function is repeated at random time. |

-continued

| Effect name | Hue and Saturation Shimmer first group |
|---|---|
| | If the first color parameter is keep constant the result would be a visual effect where the saturation and hue of the color are randomly changed resulting in a saturation and hue shimmer effect.<br>This will result in a "circling" of colors around an existing color to create dynamic color alternations like fire and water effects. |

| Effect name | Hue and saturation shimmer second group |
|---|---|
| Description | Similar the saturation shimmer first group but applied to the second group of light sources. |

| Effect name | Hue pulse first group |
|---|---|
| Input | First color parameter related to the first group of light sources; and a hue pulse parameter. |
| Output | The color of the first group of light sources is controlled based on the first color parameter and the first hue pulse parameter. |
| Effect rules | None |
| Description | The effect functions define a first fade color based on the first color parameter and the hue pulse parameter. The fade color is determined by randomly adjusting the hue of the color parameter with in a range defined by the hue pule parameter.<br>The controlling means set the color of the first light sources to a first color defined by the first color parameter and does then gradually fades the color from the first color to the fade color and back again. The function is then restarted and a new fade color is defined.<br>The consequence is that the color of the first group of light sources pulses between the first color and the fade color.<br>The deviation of the hue can be adjusted between +180 degrees and −180 degrees defined on the color circle |

| Effect name | Hue pulse second group |
|---|---|
| Description | Similar the hue pulse first group but applied to the second group of light sources. |

| Effect name | Saturation pulse first group |
|---|---|
| Input | First color parameter(s) related to the first group of light sources and<br>a first saturation pulse parameter. |
| Output | The color of the first group of light sources is controlled based on the first color parameter(s) and the first saturation pulse parameter. |
| Effect rules | None |
| Description | The effect function defines a first fade color based on the first color parameter and the first saturation parameter.<br>The fade color is determined by randomly adjusting the saturation of the color parameter within a range defined by the first saturation pule parameter.<br>The controlling means set the color of the first light sources to a first color defined by the first color parameter and does then gradually fades the color from the first color to the fade color and back again. The function is then restarted and a new fade color is defined.<br>The consequence is that the color of the first group of light sources pulses between the first color and the fade color.<br>The deviation of the saturation can be adjusted between |

| Effect name | Saturation pulse second group |
|---|---|
| Description | Similar the saturation pulse first group but applied to the second group of light sources. |

| Effect name | Hue and saturation pulse first group |
|---|---|
| Input | First color parameter related to the first group of light sources;<br>A first saturation pulse parameter;<br>A first hue pulse parameter. |
| Output | The color of the first group of light sources is controlled based on the first color parameter, the first saturation pulse parameter and the first hue parameter. |
| Effect rules | None |
| Description | The effect functions define a first fade color based on the first color parameter, the first saturation parameter and the first hue parameter. The fade color is determined by randomly adjusting the saturation and hue of the first color respectively in relation to the first saturation parameter and the hue pulse parameter. The hue and saturation are adjusted within a range defined by the first hue and first saturation parameters.<br>The controlling means set the color of the first light sources to a first color defined by the first color parameter and does then gradually fades the color from the first color to the fade color and back again. The function is then restarted and a new fade color is defined.<br>The consequence is that the color of the first group of light sources pulses between the first color and the fade color. |

| Effect name | Saturation and hue pulse second group |
|---|---|
| Description | Similar the saturation and hue pulse first group but applied to the second group of light sources. |

| Effect name | Color spikes |
|---|---|
| Input | First color parameter(s) related to the first group of light sources; a first color spike parameter; |
| Output | The color of the first group of light sources is controlled based on the first color parameter and the first color spike parameter and the first hue parameter. |
| Effect rules | None |
| Description | The color spikes effect changes the color of the first group of light sources from its' present color to a first color defined by the first color parameter(s).<br>The color is changed in a fading manner following a straight line between the present color and the first color in the color circle; however the color in each step have be adjusted in hue and saturation by a random amount, where this random amount is defined by the first color spike parameter. The random amount is further decreased the as the fade approaches the first color.<br>The result is that the colors of the first group of light sources will appear as color spikes around the straight line while finally ending with the first color. |

| Effect name | Dimmer spikes |
|---|---|
| Input | First dimmer parameter related to the first group of light sources; a first dimmer spike parameter; |
| Output | The dimmer level of the first group of light sources is controlled based on the first dimmer parameter and the first dimmer parameter. |

-continued

| Effect name | Dimmer spikes |
|---|---|
| Effect rules | None |
| Description | The dimmer spikes effect changes the dimmer level of the first group of light sources from its' present dimmer level to a first dimmer level defined by the first dimmer parameter.<br>The dimmer is changed in a fading manner from its present level to the first level; however the dimmer level in each step is adjusted with a random dimmer amount, where the random dimmer is defined by the first dimmer parameter. The random amount is further decreased the as the fade approaches the first dimmer level.<br>The result is that the dimmer of the first group of light sources will appear as dimmer spikes around the fading level and finally ending with the first dimmer level. |

| Effect name | Tungstenizer |
|---|---|
| Input | First color parameter(s) and first dimmer parameter related to the first group of light sources. |
| Output | Color and dimmer of the first group of light sources are based on the first color parameter(s) and the first dimmer parameter. |
| Effect rules | None |
| FX Adjust | The Tungsenizer simulates the dimming curve and color characteristics of a tungsten bulb.<br>When this function is activated with other dimming or strobing functions the effect would be:<br>When dimming down the color shifts from light amber to red as the intensity decreases.<br>When dimming up the color shift is reversed.<br>Snapping the intensity down will result in a decay of the intensity following a curve and the color will show the red shift.<br>Snapping the intensity up will result in a slight delay of the rise and the color will follow the red shift. Tungsten bulbs have a faster rise time up than down.<br>Fading the intensity will cause the color shift but the rise and fall delays are less pronounced the slower the fade is. |

It is to be understood that the above defined effect functions only serve as illustrating examples and that many other effect functions can be designed. Some of the effect functions are only described related to the first group of light sources, however the skilled person realize that these also can be applied to the second group of light sources.

In the illustrated embodiment the illumination device comprises an effect function library stored in memory 505 and each effect function can be activated twice through the input signal 511. The input signal is thus indicative of a first effect function and a second effect function and the illumination device is capable of combining and executing two effect functions at the same time.

The controlling means is further adapted to combine the first and second effect function based on a priority schema stored in the memory 505. The priority schema comprises a number of priority rules defining how the controlling means must execute the first effect function and said second effect in relation to each other in the case that the first output and said second output relates to at least one identical output parameter. The priority schema ensures that eventual conflicts between the first and second effect function are avoided. Conflicts may occurred if two combined effect functions both effects the same output parameter which may result in visual effect which does not look nice.

The priority schema may comprises a look-up table stored in the memory and the controlling means is adapted to find at least one of the priory rules based on the first effect function and the second effect function. The look-up table can for instance be embodied as an electronic database where the priority rules are linked to the first and second effect functions. The controlling means can thus look up the priority rules relating to the different combinations of the first and second effect functions.

In the illustrated embodiment the priority schema comprises a priority rule which defines that the first effect function has a higher priory than the second effect function; meaning that in case the first effect function and the second effect function performs output related to the same output parameters of the illumination device then the output generated by the second effect function would be overruled by same output parameters created by the first effect function. In other words if the first and second effect functions manipulate the same output parameters of the first and/or second groups of light sources then only the output crated by the first effect function would be performed by the controlling means. This rule can be used as a general rule and the illumination device can be controlled without conflicts between the first and second effect functions. However it is noted that the priority schema may comprises other priority rules which for instance act as exceptions form the general priority rule. Such priority rule can for instance be a priority rule defining that the first output form the first effect function is used as an input parameter to the second effect function. The second output from the second function is thus is determined based on said first output.

For instance a priority rule may define that the Color synchronization (se function list above) determines a color input parameter to other color functions. The effect would be that the input color to any function effecting the color of the second group of light sources will be determined based on the Color synchronization function and thus also the color of the first group of light sources.

Similar a priority rule may define that the color offset function determines the input to other color functions. The effect would be that the input color to any function effecting the color of the second group of light sources will be determined based on the Color offset function and thus also the color of the first group of light sources with an offset.

The controlling means may also be adapted to control the first and said second group of light sources based on a synchronizing schema, where the synchronizing schema comprises a number of synchronizing functions defining how said controlling means must execute the first effect function and the second effect in relation to time and in relation to each other.

One synchronization function can for instance define that the first and second effect function is executed in series after each other whereby there is not overlap between the two functions. Another synchronization function can define that the first and second effect function are executed simultaneously and must start at the same time and thus be synchronized in starting time. Yet another synchronization function can define that the first end second effect functions are executed simultaneously but that they are started at different times defined by a time offset. The time offset can for instance be determined based on the input signal indicative of a time offset or determined by randomly.

The input signal can be indicative of a synchronization parameter related to the synchronization schema which can enable the user to choose which synchronization function that must be applied.

One synchronizing function may be adapted to modify the length of the first effect function and/or the length of the second effect function, such the length of the first and the second effect function are divisible in relation to each other. Divisible relation to each other means that the length of the longest effect function can be divided by the length of the shortest effect function without a remainder. As a consequence it is possible to combine two effect functions having different lengths and synchronize the two effect functions in perfect sync. The length of the effect functions can be modified by executing each of the effect functions faster and/or slower by an amount that ensures that the two effect functions are divisible. The length can also be regulated by adjusting the length of pauses within the effect functions.

Figure 6:
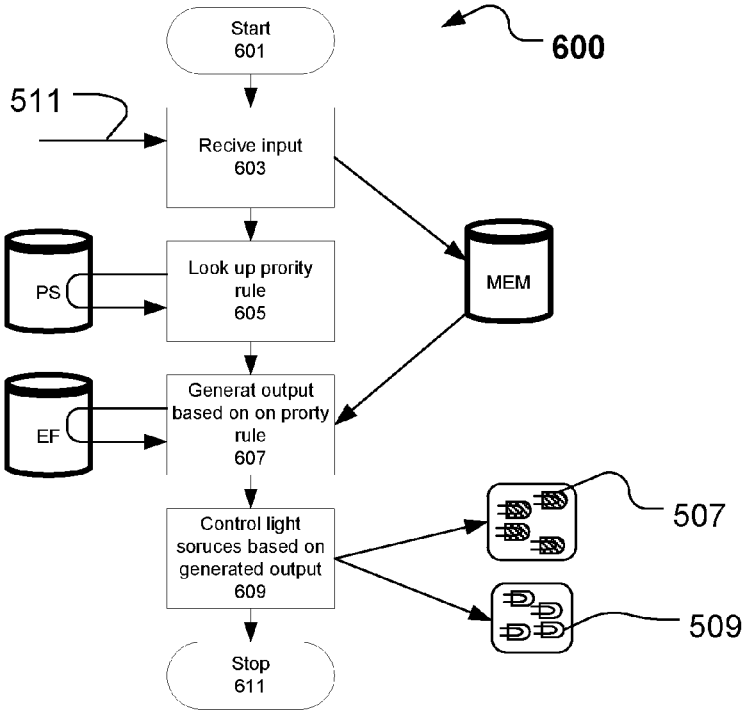
FIG. 6 illustrates a flow diagram of an method according to the present invention.

FIG. 6 illustrates a flow diagram 600 of a method where the illumination device is controlled based on at least two effect functions which are executed based on a priority scheme. The method can for instance be carried out by a controller in an illumination device comprising a number of light sources arranged in a first group 507 of light sources and in a second group of light sources 509. Initially 601 the controller is adapted to start and set the illumination device according to a predetermined initialization. The illumination is set up to receive an input signal 511 as described above and the input signal is indicative of at least a first and a second effect function.

In step 603 an identification of the first and second effect function is extracted from the input signal. Other parameters relating the controlling of the illumination device are also extracted from the input signal 511. The extracted parameters are stored in a memory MEM for later use. The other parameters can for instance be:

- a first color parameter indicative of at least the color related to the first group of light sources;
- a first strobe parameter indicative of at least a strobe frequency related to the first group of light sources;
- a first dimmer parameter indicative of at least a dimmer level related to the first group of light sources;
- a second color parameter indicative of at least a color related to the second group of light sources;
- a second strobe parameter indicative of at least a strobe frequency related to the second group of light sources;
- a second dimmer parameter indicative of at least a dimmer level related to the second group of light sources;
- at least one first effect parameter related to the first effect function;
- at least one second effect parameter related to the second effect function.

In step 605 a priority rule is looked-up in priority schema PS stored in a memory based on the identification of the first and second effect function.

In step 607 an output related to the controlling of the light sources is generated based on the identification of the first and second effect function and the in step 605 identified priority rule. The output is generated based on a number of instructions stored in an effect function library EF and based on the other parameters indicated by the input signal and stored in the MEM.

Once the output have been generated in step 609 the light sources are controlled based on the in step 609 generated outputs.

The method ends step 611 but is typical repeated continuously while the illumination device is turned on making it possible to dynamically control the illumination device using the input signal.

Figure 7:
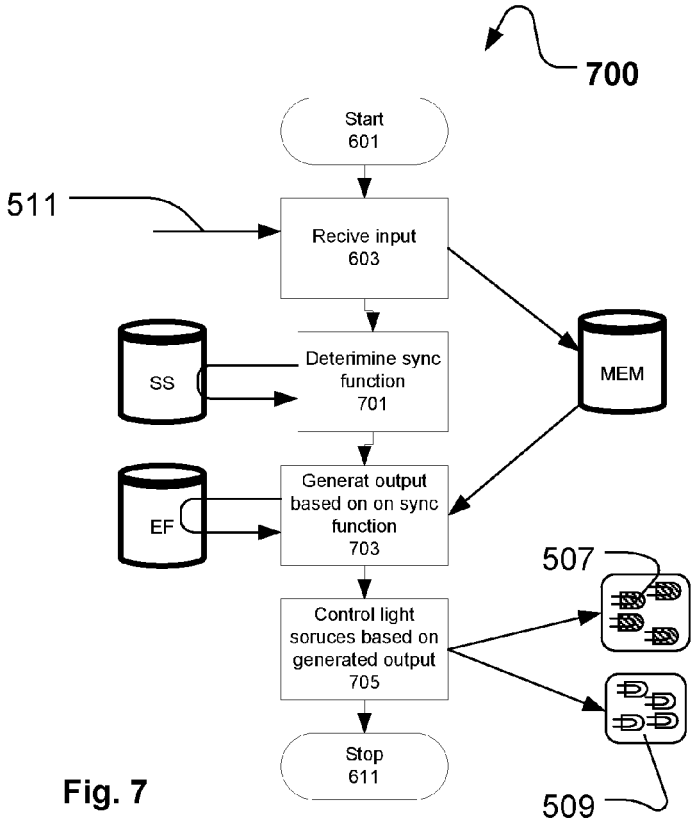
FIG. 7 illustrated a flow diagram of an method according to another aspect of the present invention.

FIG. 7 illustrates a flow diagram 700 of another method where the illumination device is controlled based on at least two effect functions which are executed based on a synchronizing scheme. The method can for instance be carried out by a controller in an illumination device comprising a number of light sources arranged in a first group of light sources and in a second group 507 of light sources 509. Initially 601 the controller is adapted to start and set the illumination device according to a predetermined initialization. The illumination is set up to receive an input signal 511 as described above and the input signal is indicative of at least a first and second effect function.

Step 601 is identical to step 601 described in connection with FIG. 6

In step 701 a synchronizing function is determined. The synchronization function may be defined based on a synchronization parameter received through the input signal 511 and/or may be based on the identification of the first and second effect function. The synchronization functions are stored in a synchronization schema SS stored in a memory.

In step 703 an output related to the controlling of the light sources is generated based on the determined synchronization function determined in step 703, the identification of the first and second effect function, and eventual other parameters received through the input signal and stored in the memory MEM.

In step 705 the light sources are controlled based on the in step 703 generated output.

The function ends step 611 but is typical repeated continuously while the illumination device is turned on making it possible to dynamically control the illumination device using the input signal.

The methods illustrated in FIGS. 6 and 7 can be combined into one method where the output defining how the light sources must be controlled is generated based on at least one priority rule and at least one synchronization function. The priority schema and synchronizations schema makes it possible to provide an illumination device where conflicts between two effect functions automatically can be solved and where two functions easily can be combined into nice visual effects.

It is noted that the invention as defined by the independent claims also applies to an illuminating device comprises further groups of light sources and where more the two effect functions are applied to the illumination device. The priority schema and the synchronization schema are respectively extended with priority rules and synchronization functions related the additional effect functions and groups of light sources.

What is claimed is:

1. A method of controlling an illumination device, said illumination device comprises a number of light sources arranged in at least a first group of light sources and in a second group of light sources, where said method comprises:

receiving an input signal indicative of a number of control parameters, a first effect function, and a second effect function;

controlling said first group of light sources and said second group of light sources individually based on said input signal; where said first effect function indicates a first output related to said number of light sources and said second effect function indicates a second output related to said light sources; said first and second effect functions being stored in a memory in said illumination device;

wherein the controlling is based on a priority schema stored in a memory in said illumination device; where said priority schema comprises a number of priority rules defining how said first effect function and said second effect function are executed in relation to each other in the case that said first output defines an output parameter which is identical to an output parameter defined by said second output, wherein at least one of said priority rules defines that said first effect function has a higher priority than said second effect function, and wherein the controlling comprises ignoring said output parameter defined by said second output which is identical to said output parameter defined by said first output, wherein at least one of said priority rules defines that said first output is used as an input parameter to said second effect function and wherein the controlling comprises determining said second output based on said first output.

2. A method according to claim 1 wherein said priority schema comprises a look-up table and in that said step of controlling said light sources comprises the step of finding at least one of said priority rules in said look-up table based on said first effect function, said second effect function, or said control parameters.

3. A method according to claim 1 wherein the controlling is based on synchronizing schema stored in a memory in said illumination device, where said synchronizing schema comprises a number of synchronizing functions defining how said first effect function and said second effect function are executed in relation to time and in relation to each other.

4. A method according to claim 1 wherein said number of control parameters comprises at least one of the following parameters:

a first color parameter indicative of at least the color related to said first group of light sources;

a first strobe parameter indicative of at least a strobe frequency related to said first group of light sources;

a first dimmer parameter indicative of at least a dimmer level related to said first group of light sources;

a second color parameter indicative of at least a color related to said second group of light sources;

a second strobe parameter indicative of at least a strobe frequency related to said second group of light sources;

a second dimmer parameter indicative of at least a dimmer level related to said second group of light sources;

at least one first effect parameter related to said first effect function; and at least one second effect parameter related to said second effect function;

wherein at least one of said control parameters is used as an input parameter to at least one of said first effect function and said second effect function.

5. A method according to claim 1 wherein said illumination device comprises:

a number of light collecting means, said number of light collecting means collect light from said first group of light sources and convert said collected light into a number of source light beams;

said number of light sources and number of light collecting means are arranged in a housing from which said light sources beams are emitted; said housing comprises a diffuser cover comprising:

at least one diffuser region, said diffuser region receives light generated by said second group of light sources and diffuses said received light; and at least one non-diffusing region where through at least at part of said number of source light beams pass without being diffused.

6. An illumination device comprising:

a number of light sources arranged in at least a first group of light sources and in a second group of light sources;

controlling means configured to receive an input signal indicative of a number of control parameters, a first effect function, and a second effect function; said controlling means being adapted to control said first group of light sources and said second group of light sources individually based on said input signal;

wherein said first effect function indicates a first output related to said number of light sources and said second effect function indicates a second output related to said light sources; said first effect function and said second effect function are stored in a memory of said illumination device;

wherein the controlling means is adapted to control said first and said second group of light sources based on a priority schema, where said priority schema are stored in said memory of said illumination device and comprises a number of priority rules defining how said controlling means execute said first effect function and said second effect function in relation to each other in the case that said first output defines an output parameter which is identical to an output parameter defined by said second output, wherein at least one of said priority rules defines that said first effect function has a higher priority than said second effect function, and wherein said output parameter defined by said second output that is identical to said output parameter defined by said first output is ignored by said controlling means, wherein at least one of said priority rules defines that said first output is used as an input parameter to said second effect function and that said second output is determined based on said first output.

7. An illumination device according to claim 6 wherein said priority schema comprises a look-up table and in that said controlling means is adapted to find at least one of said priority rules in said look-up table based on said first effect function, said second effect function, or said control parameters.

8. An illumination device according to claim 6 wherein the said controlling means is adapted to control said first and said second group of light sources based on a synchronizing schema, where said synchronizing schema is stored in a memory in said illumination device and comprises a number of synchronizing functions defining how said controlling means execute said first effect function and said second effect function in relation to time and in relation to each other.

9. An illumination device according to claim 6 wherein said number of control parameters comprises at least one of the following parameters:

a first color parameter indicative of at least the color related to said first group of light sources;

a first strobe parameter indicative of at least a strobe frequency related to said first group of light sources;

a first dimmer parameter indicative of at least a dimmer level related to said first group of light sources;

a second color parameter indicative of at least a color related to said second group of light sources;

a second strobe parameter indicative of at least a strobe frequency related to said second group of light sources;

a second dimmer parameter indicative of at least a dimmer level related to said second group of light sources;

at least one first effect parameter related to said first effect function; and at least one second effect parameter related to said second effect function;

wherein at least one of said control parameters is used as an input parameter to at least one of said first effect function and said second effect function.

10. An illumination device according to claim 6 wherein said illumination device comprises:

a number of light collecting means, said number of light collecting means collect light from said first group of light sources and convert said collected light into a number of source light beams;

said number of light sources and number of light collecting means are arranged in a housing from which said light sources beams are emitted; said housing comprises a diffuser cover comprising:

at least one diffuser region, said diffuser region receives light generated by said second group of light sources and diffuses said received light; and at least one non-diffusing region where through at least at part of said number of source light beams pass without being diffused.

11. A method of controlling an illumination device, said illumination device comprises a number of light sources arranged in at least a first group of light sources and in a second group of light sources, where said method comprises:

controlling said first group of light sources and said second group of light sources individually based on an input signal indicative of at least a first effect function and a second effect function; where said first effect function generates a first output related to said number of light sources and said second effect function generates a second output related to said light sources, said first effect function and said second effect function are stored in a memory in said illumination device;

wherein the controlling is based on a synchronizing schema, where said synchronizing schema is stored in a memory in said illumination device and comprises a number of synchronizing functions defining how said first effect function and said second effect function are executed in relation to time and in relation to each other, wherein at least one of said synchronizing functions defines that said first effect function and said second effect function are executed simultaneously and start at a same time or a time offset in relation to each other, wherein said controlling means is adapted to control said first and said second group of light sources based on a priority schema, where said priority schema is stored in a memory in said illumination device and comprises a number of priority rules defining how said controlling means executes said first effect functions and said second effect in relation to each other in the case that said first output and said second output relates to at least one identical output parameter, and wherein at least one of said priority rules defines that said first output is used as an input parameter to said second effect function and wherein the controlling comprises determining said second output based on said first output.

12. A method according to claim 11 wherein said first effect function and said second effect function start at the same time and in that said step of controlling said light sources comprises the step of activating said first effect function and said second effect function at the same time.

13. A method according to claim 11 wherein said first effect function and said second effect function start at a time offset in relation to each other and in that said step of controlling said light sources comprises the step of activating said first effect function and said second effect function at different times separated by said time offset.

14. A method according to claim 11 wherein at least one of said synchronizing functions defines that said time offset is determined randomly.

15. A method according to claim 11 wherein at least one of said synchronizing functions is adapted to modify the length of said first effect function and/or said second effect function such that the length of said first and said second effect function are divisible in relation to each.

16. A method according to claim 11 wherein said input signal is indicative of at least one synchronizing function and in that the controlling said light sources is based on said at least one synchronizing function indicated by said input signal.

17. A method according to claim 11 wherein the controlling said light sources is based on at least one of the following parameters:

a first color parameter indicative of at least the color related to said first group of light sources;

a first strobe parameter indicative of at least a strobe frequency related to said first group of light sources;

a first dimmer parameter indicative of at least a dimmer level related to said first group of light sources;

a second color parameter indicative of at least a color related to said second group of light sources;

a second strobe parameter indicative of at least a strobe frequency related to said second group of light sources;

a second dimmer parameter indicative of at least a dimmer level related to said second group of light sources;

at least one first effect parameter related to said first effect function; and at least one second effect parameter related to said second effect function.

18. A method according to claim 11 wherein said illumination device comprises:

a number of light collecting means, said number of light collecting means collect light from said first group of light sources and convert said collected light into a number of source light beams;

said number of light sources and number of light collecting means are arranged in a housing from which said light sources beams are emitted; said housing comprises a diffuser cover comprising:

at least one diffuser region, said diffuser region receives light generated by said second group of light sources and diffuses said received light; and at least one non-diffusing region where through at least at part of said number of source light beams pass without being diffused.

19. An illumination device comprising:

a number of light sources arranged in at least a first group of light sources and in a second group of light sources;

controlling means adapted to control said first group of light sources and said second group of light sources individually, where said controlling means is adapted to control said first group of light sources and said second group of light sources based on an input signal indicative of at least a first effect function and a second effect function; said first effect function generates a first output related to said number of light sources and said second effect function generates a second output related to said light sources, said first effect function and said second effect function are stored in a memory in said illumination device;

wherein the controlling means is adapted to control said first and said second group of light sources based on a synchronizing schema, where said synchronizing schema is stored in a memory in said illumination device and comprises a number of synchronizing functions defining how said controlling means execute said first effect function and said second effect function in relation to time and in relation to each other, wherein at least one of said synchronizing functions defines that said first effect function and said second effect function are executed simultaneously and start at a same time or a time offset in relation to each other, wherein said controlling means is adapted to control said first and said second group of light sources based on a priority schema, where said priority schema is stored in a memory in said illumination device and comprises a number of priority rules defining how said controlling means executes said first effect functions and said second effect in relation to each other in the case that said first output and said second output relates to at least one identical output parameter, and wherein at least one of said priority rules defines that said first output is used as an input parameter to said second effect function and wherein the controlling comprises determining said second output based on said first output.

20. An illumination device according to claim 19 wherein at least one of said synchronizing functions defines that said time offset is determined randomly.

21. An illumination device according to claim 19 wherein at least one of said synchronizing functions is adapted to modify the length of said first effect function and/or said second effect function such the length of said first and said second effect function are divisible in relation to each other.

22. An illumination device according to claim 19 wherein said input signal is indicative of at least one synchronizing function and in that said controlling means is adapted to choose at least one of said synchronizing functions based on said least one synchronizing function indicated by said input signal.

23. An illumination device according to claim 19 wherein said controlling means is adapted to control said light sources based on at least one of the following parameters:

a first color parameter indicative of at least the color related to said first group of light sources;

a first strobe parameter indicative of at least a strobe frequency related to said first group of light sources;

a first dimmer parameter indicative of at least a dimmer level related to said first group of light sources;

a second color parameter indicative of at least a color related to said second group of light sources;

a second strobe parameter indicative of at least a strobe frequency related to said second group of light sources;

a second dimmer parameter indicative of at least a dimmer level related to said second group of light sources;

at least one first effect parameter related to said first effect function; and at least one second effect parameter related to said second effect function.

24. An illumination device according to claim 19 wherein said illumination device comprises:

a number of light collecting means, said number of light collecting means collect light from said first group of light sources and convert said collected light into a number of source light beams;

said number of light sources and number of light collecting means are arranged in a housing from which said light sources beams are emitted; said housing comprises a diffuser cover comprising:

at least one diffuser region, said diffuser region receives light generated by said second group of light sources and diffuses said received light; and at least one non-diffusing region where through at least at part of said number of source light beams pass without being diffused.

25. A method of controlling an illumination device, said illumination device comprises a number of light sources arranged in at least a first group of light sources and in a second group of light sources, where said method comprises:

receiving an input signal indicative of a number of control parameters, a first effect function, and a second effect function;

controlling said first group of light sources and said second group of light sources individually based on said input signal; where said first effect function indicates a first output related to said number of light sources and said second effect function indicates a second output related to said light sources; said first and second effect functions being stored in a memory in said illumination device;

wherein the controlling is based on a priority schema stored in a memory in said illumination device; where said priority schema comprises a number of priority rules defining how said first effect function and said second effect function are executed in relation to each other in the case that said first output defines an output parameter which is identical to an output parameter defined by said second output, wherein at least one of said priority rules defines that said first effect function has a higher priority than said second effect function, and wherein the controlling comprises ignoring said output parameter defined by said second output which is identical to said output parameter defined by said first output, wherein:

said control parameters indicate a third output related to said light sources;

said priority schema comprises a number of priority rules defining how said first effect function, said second effect function, and said control parameters are executed in relation to each other in the case that said first output defines an output parameter which is identical to an output parameter defined by said second output or said third output;

at least one of said priority rules defines that said first effect function has a higher priority than said second effect function or said control parameters; and the controlling comprises ignoring said output parameter defined by said second output or said third output which is identical to said output parameter defined by said first output.

26. A method of controlling an illumination device, said illumination device comprises a number of light sources arranged in at least a first group of light sources and in a second group of light sources, where said method comprises:

controlling said first group of light sources and said second group of light sources individually based on an input signal indicative of at least a first effect function and at least a second effect function; where said first effect function generates a first output related to said number of light sources and said second effect function generates a second output related to said light sources; said first and second effect functions being stored in a memory in said illumination device;

wherein the controlling is based on a priority schema stored in a memory in said illumination device; where said priority schema comprises a number of priority rules defining how said first effect function and said second effect function are executed in relation to each other in the case that said first output and said second output relate to at least one identical output parameter, wherein at least one of said priority rules defines that said first output is used as an input parameter to said second effect function and wherein the controlling comprises determining said second output based on said first output.

27. A method of controlling an illumination device, said illumination device comprises a number of light sources arranged in at least a first group of light sources and in a second group of light sources, where said method comprises:

controlling said first group of light sources and said second group of light sources individually based on an input signal indicative of at least a first effect function and at least a second effect function; where said first effect function generates a first output related to said number of light sources and said second effect function generates a second output related to said light sources; said first and second effect functions being stored in a memory in said illumination device;

wherein the controlling is based on a priority schema stored in a memory in said illumination device; where said priority schema comprises a number of priority rules defining how said first effect function and said second effect function are executed in relation to each other in the case that said first output and said second output relate to at least one identical output parameter, wherein the controlling is based on synchronizing schema stored in a memory in said illumination device, where said synchronizing schema comprises a number of synchronizing functions defining how said first effect function and said second effect function are executed in relation to time and in relation to each other.

28. An illumination device comprising:

a number of light sources arranged in at least a first group of light sources and in a second group of light sources;

controlling means adapted to control said first group of light sources and said second group of light sources individually, where said controlling means is adapted to control said first group of light sources and said second group of light sources based on an input signal indicative of at least a first effect function and at least a second effect function; said first effect function generates a first output related to said number of light sources and said second effect function generates a second output related to said light sources; said first effect function and said second effect function are stored in a memory in said illumination device;

wherein the controlling means is adapted to control said first and said second group of light sources based on a priority schema, where said priority schema are stored in a memory in said illumination device and comprises a number of priority rules defining how said controlling means execute said first effect function and said second effect function in relation to each other in the case that said first output and said second output relate to at least one identical output parameter, wherein at least one of said priority rules defines that said first output is used as an input parameter to said second effect function and that said second output is determined based on said first output.

29. An illumination device comprising:

a number of light sources arranged in at least a first group of light sources and in a second group of light sources;

controlling means adapted to control said first group of light sources and said second group of light sources individually, where said controlling means is adapted to control said first group of light sources and said second group of light sources based on an input signal indicative of at least a first effect function and at least a second effect function; said first effect function generates a first output related to said number of light sources and said second effect function generates a second output related to said light sources; said first effect function and said second effect function are stored in a memory in said illumination device;

wherein the controlling means is adapted to control said first and said second group of light sources based on a priority schema, where said priority schema are stored in a memory in said illumination device and comprises a number of priority rules defining how said controlling means execute said first effect function and said second effect function in relation to each other in the case that said first output and said second output relate to at least one identical output parameter, wherein the said controlling means is adapted to control said first and said second group of light sources based on a synchronizing schema, where said synchronizing schema is stored in a memory in said illumination device and comprises a number of synchronizing functions defining how said controlling means execute said first effect function and said second effect function in relation to time and in relation to each other.

* * * * *